US007313877B2

(12) United States Patent
Clendenning et al.

(10) Patent No.: US 7,313,877 B2
(45) Date of Patent: Jan. 1, 2008

(54) PIN ASSEMBLY FOR A TWO-PART GROUND ENGAGING TOOTH SYSTEM AND METHOD FOR CONNECTING COMPONENTS OF A TWO-PART GROUND ENGAGING TOOTH SYSTEM TO EACH OTHER

(75) Inventors: Charles Clendenning, Broken Arrow, OK (US); Brian L. Launder, Tulsa, OK (US)

(73) Assignee: H&L Tooth Company, Tulsa, OK (US)

( * ) Notice: Subject to any disclaimer, the term of this patent is extended or adjusted under 35 U.S.C. 154(b) by 0 days.

(21) Appl. No.: 11/218,173

(22) Filed: Sep. 1, 2005

(65) Prior Publication Data

US 2006/0059732 A1 Mar. 23, 2006

Related U.S. Application Data

(60) Provisional application No. 60/610,798, filed on Sep. 17, 2004.

(51) Int. Cl.
*E02F 9/28* (2006.01)

(52) U.S. Cl. ..... 37/456; 37/459; 403/220

(58) Field of Classification Search ..... 37/452–456, 37/459; 299/102; 172/713; 403/154, 156, 403/220

See application file for complete search history.

(56) References Cited

U.S. PATENT DOCUMENTS

| | | | | |
|---|---|---|---|---|
| 282,077 | A * | 7/1883 | Hardin | 411/337 |
| 3,511,126 | A * | 5/1970 | Watts | 411/512 |
| 3,526,435 | A | 9/1970 | Krekeler | |
| 3,831,298 | A * | 8/1974 | Helton et al. | 37/457 |
| 4,324,057 | A | 4/1982 | White | |
| 4,326,348 | A * | 4/1982 | Emrich | 37/453 |
| 4,338,736 | A | 7/1982 | Radigan | |
| 4,516,340 | A | 5/1985 | Launder | |
| 5,077,918 | A * | 1/1992 | Garman | 37/452 |
| 5,272,824 | A | 12/1993 | Cornelius | |
| 5,765,301 | A | 6/1998 | Clendenning | |
| 5,833,323 | A * | 11/1998 | Massa et al. | 299/102 |
| 5,909,962 | A * | 6/1999 | Livesay et al. | 37/456 |
| 5,937,550 | A * | 8/1999 | Emrich | 37/458 |
| 6,374,521 | B1 * | 4/2002 | Pippins | 37/456 |
| 6,439,796 | B1 * | 8/2002 | Ruvang et al. | 403/157 |
| 6,757,995 | B2 * | 7/2004 | Pippins | 37/468 |
| 6,799,387 | B2 * | 10/2004 | Pippins | 37/456 |
| 6,959,506 | B2 | 11/2005 | Adamic et al. | |
| 7,032,334 | B2 * | 4/2006 | Pippins | 37/455 |
| 2002/0023375 | A1 * | 2/2002 | Pippins | 37/457 |
| 2003/0070330 | A1 * | 4/2003 | Olds et al. | 37/456 |
| 2005/0066555 | A1 | 3/2005 | Adamic | |

* cited by examiner

*Primary Examiner*—Thomas A Beach
(74) *Attorney, Agent, or Firm*—John W. Harbst

(57) ABSTRACT

A pin assembly for releasably maintaining an adapter and replaceable part or tool of a two-part digging system in operable combination relative to each other. The pin assembly includes a pair of axially aligned retaining pins whose opposed ends are arranged in operable combination relative to each other. Each retaining pin has an enlarged head portion configured to fit within one of the openings defined by the tool, and a shank portion. An axially arranged and rotatable fastener maintains the opposed distal ends of the pins in releasably secured relation relative to each other. A method for releasably maintaining the digging tooth/tool and adapter is operable combination is also disclosed.

15 Claims, 10 Drawing Sheets

FIG. 16
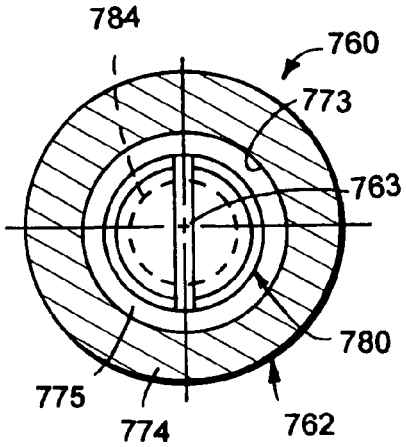
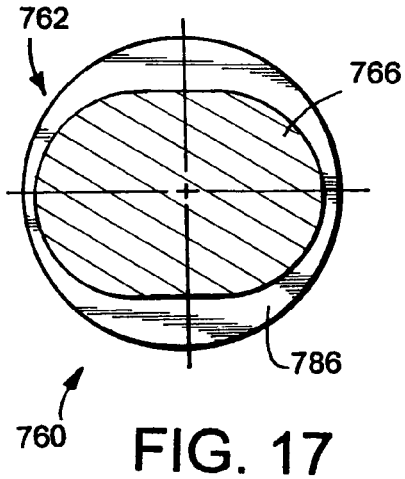
FIG. 17
FIG. 15
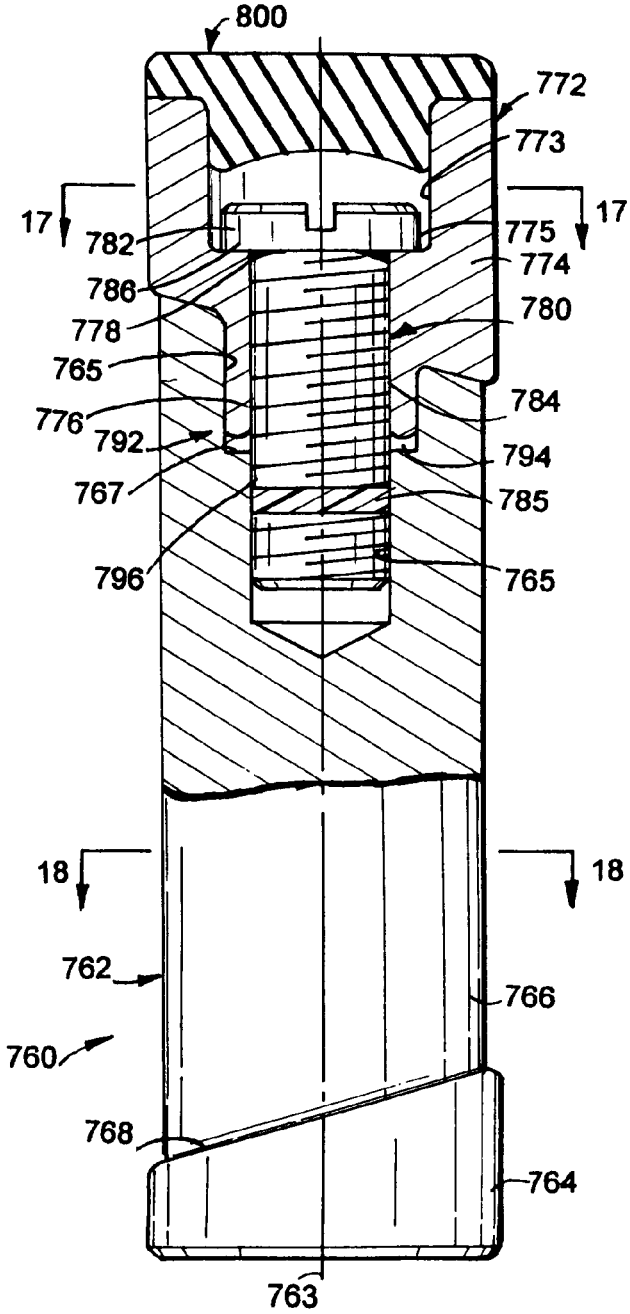

PIN ASSEMBLY FOR A TWO-PART GROUND ENGAGING TOOTH SYSTEM AND METHOD FOR CONNECTING COMPONENTS OF A TWO-PART GROUND ENGAGING TOOTH SYSTEM TO EACH OTHER

CROSS REFERENCE TO RELATED APPLICATIONS

This application claims the benefit of prior U.S. provisional application Ser. No. 60/610,798, filed Sep. 17, 2004, and entitled "HAMMERLESS PIN ASSEMBLY FOR A TWO-PART GROUND ENGAGING TOOTH SYSTEM".

FIELD OF THE INVENTION

The present invention generally relates to a two-part ground engaging tooth system and, more specifically, to a pin assembly for maintaining an adapter and a replacement part of a two-part ground engaging tooth system in operable combination relative to each other and to a method for connecting component parts of a two-piece ground engaging tooth system to each other.

BACKGROUND OF THE INVENTION

Excavating equipment used in mining, construction and a myriad of other ground engaging operations typically includes a series of spaced apart ground engaging tools which project forward and serve to break up material to be gathered into a bucket of such excavating equipment. To enhance the ability of such ground engaging tools to break up the material in advance of a forward edge of the excavating bucket or the like, the tools are arranged in side-by-side and horizontal proximity relative to each other.

Such ground engaging tools can take a myriad of shapes and sizes. As used herein, the phrase "tools" is purposefully intended to include lip protectors, lip shrouds, rippers and other ground engaging tools including, but not limited to, ground engaging tooth assemblies. For exemplary purposes, the present invention is illustrated and described for use with a two-piece ground engaging tooth assembly. As mentioned, however, the present invention is equally applicable to other ground engaging equipment adapted for releasable securement to a forward edge or lip of an bucket or related excavating equipment.

The art recognized long ago the advantages to be gained by constructing each digging tooth as a two-part system. That is, the art recognized the advantages to be obtained by connecting a ground engaging tooth or tool to an adapter or support which, in turn, is connected to the bucket of excavating equipment. Typically, the adapter or support is provided with a base portion which is configured for attachment to the forward lip or blade of a bucket and a free ended nose portion. The digging tool is typically provided with a blind cavity or pocket whereby allowing the tool to fit over and along the adapter nose portion. As will be appreciated by those skilled in the art, the size of the adapter and digging tooth vary depending upon the particular digging application. For example, a two-part digging tooth system can vary in weight between a few pounds, i.e., three to five pounds, to two-hundred pounds.

In some digging operations, such teeth assemblies are subjected to highly abrasive conditions and, thus, experience considerable and rapid wear. Unless the conjuncture between the component parts of the two-part system is properly fitted, wear problems, especially in the pocket or cavity of the replacement part and along the nose portion of the adapter, can result. Moreover, the relatively high forces developed during some digging operations furthermore add to the rapid wear of the component parts of the digging tooth assembly.

In service, and although specific steps can be taken during fabrication of the digging teeth to prolong the usefulness thereof, a forward cutting edge of the replacement part sometimes quickly wears and become dull and, thus, inefficiencies in the digging operation develop thereby requiring replacement of such parts. As mentioned, the multipiece or two-part construction of such a tooth assembly advantageously allows the digging or excavating tool to be replaced independent of the adapter. Depending upon conditions, a given adapter can be successfully equipped with anywhere from five to thirty replacement digging teeth to maintain sharp penetrating edges. In the field, replacement of worn excavating or digging teeth is a common and sometimes a daily experience.

It is well known in the industry to releasably interconnect the component parts of the two-piece assembly with an elongated retaining pin. Removing or separating a worn or otherwise broken tool from its support, however, can involve a tedious and often difficult task of pounding the retaining pin from registering apertures in component parts of the two-piece assembly. Removal of the retaining pin is typically effected by using a large hammer to manually and endwise force the retaining pin from the apertures in the digging tooth and adapter. Of course, with larger two-part digging systems, the retaining pins are proportionately sized larger thereby adding to the manual effort and, thus, increasing the time and effort involved to effect digging tooth replacement and/or repair. Problems involving the hammer missing the punch or other tool used to removably pound the retaining pin and hitting the hand of the operator are well known. Of course, similar problems exist when the retaining pin is again pounded into the apertures to effect reattachment of the replacement part to the adapter. The unavailability of appropriate tools, i.e., hammers and punches, in the field is also a consistent and well known problem.

Many two part digging tool systems arrange the retaining pin along a generally horizontal axis. As will be appreciated by those skilled in the art, with the digging tooth assemblies being mounted in side-by-side relation relative to each other across the bucket lip, the horizontal disposition of the retainer pin for each digging system only adds to the time and effort required to initially remove the pin, whereby allowing for removal/repair of the worn/broken part of the two-part digging system and, subsequently, reinsertion of the pin into the registered apertures in the replacement part and adapter. Some operators utilize specially designed tools to facilitate removal of the horizontal pins.

It is also known to arrange the retaining pin in a generally vertical orientation. While advantageously enhancing access to the retaining pin, such retaining devices are more susceptible to the forces applied thereto as a result of the generally vertical movements of the bucket during a digging/excavating operation. Moreover, with a vertically oriented pin system, the lower hole or aperture in the replacement part of the two-part digging system is more exposed—as compared to a horizontal pinning system—to the ground surface over which the digging implement or bucket moves during a digging operation.

In any digging or excavating operation, contaminants including rocks, dust, dirt fines, moisture, and etc. furthermore exacerbate removal of the retaining pin. During any digging or excavating operation, small rocks, stones, dirt, dirt fines, and dust quickly accumulate, fill, and pack into holes or apertures in the digging tooth and adapter. As will be appreciated, moisture readily and quickly moves between confronting surfaces formed at the conjuncture of the digging tooth and adapter and passes toward the retaining pin. Moisture tends to corrode and rust or oxidize on the surfaces of both the retainer pin and closed margins of the apertures in the digging tooth and adapter thereby adding to the problem of retaining pin removal. Moreover, such moisture often combines with the small rocks, stones, dirt, dirt fines, and dust already packed and filled into the apertures or holes of the component parts of the two-part tooth system, thereby adding to the considerable labor already involved with effecting tooth replacement.

Using threaded devices for releasably interconnecting component parts of a two-part tooth system has been previously proposed. For example, U.S. Pat. Nos. 5,337,495 and 6,052,927 to S. Pippins disclose an externally threaded tooth point bolt in combination with an insert for releasably maintaining a digging tooth and adapter in operable combination relative to each other. Like others before, the Pippins devices do not solve the problem of having contaminants including small rocks, stones, dirt, dirt fines, dust, and moisture passing into the apertures and onto both internal and external threads of the interconnecting devices thereby resulting in clogging, oxidation and corrosion of the mating surfaces. Of course, contamination of any mating threaded surfaces as by clogging, oxidation or rusting can only further add to the problems of disconnecting the related parts relative to each other when servicing of the worn part of the two-part system, is required. Moreover, the Pippins devices fail to disclose any means for inhibiting wear between the component parts of a two-part digging tooth system.

Thus, there is a continuing need and desire for a pin assembly used to releasably and operably maintain component parts of a two-part ground engaging tooth system in operable combination relative to each other.

SUMMARY OF THE INVENTION

In view of the above, there is provided a pin assembly for releasably maintaining component parts of a two-part ground engaging tooth system in operable combination. The component parts of the ground engaging system include an adapter, having a nose portion with multiple sides, and a ground engaging tool defining an open ended blind cavity or pocket for allowing the tool to fit over and along a lengthwise section of the adapter nose portion. The adapter defines a pin receiving bore having a closed marginal edge. The tool defines a pair of aligned openings each having a closed marginal edge and a blind cavity disposed between the respective openings defined by the tooth.

According to one aspect, the pin assembly includes first and second axially aligned pins. Each pin has a head portion and a shank portion. The first pin of the assembly is configured such that, after being inserted through one of the axially aligned openings defined by the tooth, the shank portion of the pin engages at least a lengthwise section of the marginal portion of the bore defined by the nose portion of the adapter while the head portion of the pin engages a marginal portion of the respective opening in the tooth through which the first pin is inserted. To provide flexural rigidity to the pin assembly, end sections of the shank portions of the two pins are arranged in operable combination relative to other. A fastener is axially insertable through one of the two pins and is threadably engagable with the other pin. The fastener serves to maintain the end sections of the pins in operable combination relative to each other whereby maintaining the tooth and support in operable relation relative to each other.

In one form, the second pin of the assembly is configured such that, after the second pin is inserted through the other of the axially aligned openings defined by the tooth, the shank portion of the second pin likewise engages at least a lengthwise section of the marginal portion of the bore defined by the nose portion of the adapter while the head portion of the second pin engages a marginal portion of the respective opening in said tooth through which the second pin is inserted.

Preferably, and to provide flexural rigidity for the pin assembly, the end sections of the shank portions of the first and second pins are arranged in telescoping relation relative to each other. Seal structure is preferably arranged in operable combination with the pin assembly for inhibiting contaminants from interfering with proper operation of the fastener and that pin threadably engagable with the fastener. Moreover, the pin assembly preferably includes structure, operably associated with that pin through which the fastener is axially inserted, for protecting the fastener and inhibiting contaminants from interfering with proper operation of the fastener.

In one form, the shank portion of each pin has a generally cylindrical-like configuration along a major lengthwise section thereof. In another form, the head portion of each pin has a generally cylindrical-like configuration and the shank portion of each pin has a generally elliptical-like configuration along a major lengthwise section thereof. According to yet another embodiment, the shank portion of one of the two pins of the assembly extends for a distance substantially equal to the length of the bore extending through the adapter.

According to another aspect, the pin assembly includes a first elongated and rigid member and a second rigid member adapted to be arranged in axial relation relative to said first member. Each rigid member includes a head portion and a shank portion. The first rigid member is configured such that, after being axially inserted through one of said axially aligned openings defined by the tooth, the shank portion of the first member engages with at least a lengthwise section of a marginal portion of the bore defined by the nose portion of the adapter while the head portion of the first member engages with a marginal portion of the respective opening in the tooth through which said first member is inserted. To add structural rigidity to the pin assembly, end sections of the shank portions on the members are arranged in cooperative relation relative to each other. An elongated fastener, axially insertable through one of the members, forms a threaded juncture with the other member so as to releasably maintain the end sections of the members in cooperative relation relative to each other whereby securing the tooth and adapter in operable combination relative to each other.

In a preferred embodiment, the second member is configured such that, after being inserted through the other of the axially aligned openings of the tooth, the shank portion of the second member engages at least a lengthwise section of the marginal portion of the bore defined by the nose portion of the adapter while the head portion of the second member engages a marginal portion of the respective opening in the tooth through which the second member is inserted. In a most preferred embodiment, the end sections of the shank portions of the first and second members are arranged in telescoping relation relative to each other.

Preferably, the pin assembly further includes seal structure disposed in combination with the first and second members for inhibiting contaminants from interfering with proper operation of the fastener and that member threadably engagable with the fastener. In a most preferred form, the pin assembly also includes a cap operably associated with that member through which the fastener is axially inserted for protecting the fastener and inhibiting contaminants from interfering with proper operation of the fastener.

In one embodiment, the shank portion of each member has a generally cylindrical-like cross-sectional configuration along a major lengthwise section thereof. In another form, the head portion of each member has a generally cylindrical-like configuration and the shank portion of each member has a generally elliptical-like cross-sectional configuration along a major lengthwise section thereof.

According to another aspect, the pin assembly includes first and second elongated and rigid members adapted to be arranged in axial relation relative to each other. Each rigid member includes an enlarged head portion and a shank portion. A length of the shank portion of each member is less than a distance between the spaced and opposed surfaces on the adapter through which the shank portion of the member is inserted. Moreover, each rigid member is configured such that, after being axially inserted through the axially aligned openings defined by the tooth, the shank portion of each member is adapted to engage with a marginal portion of the bore defined by the nose portion of the adapter while the head portion of each member is configured to engage with a marginal portion of the respective opening in the tooth through which the member is inserted. To add rigidity to the pin assembly, an end section of the shank portion on one member is arranged in telescoping relation relative to the end section of the shank portion of the other member. An elongated fastener is axially insertable through one of the members to form a threaded juncture with the other member so as to releasably maintain the end sections of the members in telescopic relation relative thereby reducing stress on the fastener while maintaining the tooth and adapter in operable combination relative to each other.

Preferably, the pin assembly further includes seal structure, disposed in operable combination with the first and second members, for inhibiting contaminants from interfering with proper operation of the fastener and that member threadably engagable with the fastener. In a most preferred form, the pin assembly further includes a cap operably associated with that member through which the fastener is axially inserted for protecting the fastener and inhibiting contaminants from interfering with proper operation of the fastener.

According to still another aspect, there is provided a method for releasably securing a ground engaging tool on a nose portion of a mounting support by extending through spaced and substantially aligned first and second openings defined by the tool and a bore defined by the nose portion of said support. The method comprises the steps of: inserting a first member into a lengthwise section of the bore in the nose portion of the support through the first opening defined by the tool, with the first member including a head portion and a shank portion, with the head portion of the first member being configured to engage with a marginal portion of the respective opening in the tool through which that member is inserted, and with the shank portion of the first member being configured to engage with a marginal portion of the bore defined by the nose portion of the adapter; inserting a second member into a lengthwise section of the bore in the nose portion of the support through the other opening defined by the tool, with the second member including a head portion and a shank portion, with the head portion of the second member being configured to engage with a marginal portion of the respective opening in the tool through which the second member is inserted, and with a free end of the shank portion of the second member being configured to be arranged in a cooperative relation relative to the free end of the shank portion of the first member so as to add structural rigidity to the pin assembly; and then securing the first and second members against inadvertent axial displacement within the first and second aligned openings defined by the tool and the bore defined by the nose portion of the support.

In one form, the method for securing a ground engaging tool on a nose portion of a mounting support includes the further step of: inserting a threaded fastener through one of the members to form a threaded juncture with the other member whereby securing the first and second members against inadvertent axial displacement relative to each other. In another form, the method for securing a ground engaging tool on a nose portion of a mounting support includes the further step of: protecting the threaded juncture established between said fastener and member by inhibiting dirt, debris, or moisture from contaminating said threaded juncture.

A primary feature of the present invention relates to providing an improved, multipiece pin assembly for releasably maintaining a replacement part and an adapter of a two-part digging system in operable combination relative to each other.

A further feature of this invention relates to providing a hammerless pin assembly for a two-part digging system including a replacement part and an adapter and which offers enhanced ease of repair/replacement of the replacement part, when required, during a digging operation.

Still another feature of this invention relates to providing a pin assembly for a two-part digging system including a replacement part and an adapter and wherein the two-parts of the digging system are maintained in operable combination relative to each other through a rotatable fastener used to releasably hold two pins of the pin assembly in operable combination relative to each other and wherein elastomeric material inhibits contaminants, inherent with digging environments, from adversely effecting a threaded juncture between the fastener and one of the pins of the pin assembly thereby promoting release of the fastener from the pin, when required, and, thus, enhancing repair/replacement of worn parts of the two-part digging system.

Yet another feature of this invention relates to a methodology involving inserting pins from opposed axial directions and through axially aligned openings in the ground engaging tool so as to allow end sections on the shank portions of the pins to be arranged in operable combination relative to each other and thereafter securing the end sections relative to each other such that the pins are inhibited against inadvertent axial shifting movements thereby securing the tool and mounting adapter in operable combination relative to each other.

These and other numerous objects, aims, and advantages of the present invention will become readily apparent from the following detailed description, drawings, and appended claims.

DESCRIPTION OF THE DRAWINGS

FIG. 15 is a plan view of the alternative pin assembly illustrated in FIG. 14 with parts broken away to show details of the pin assembly;

FIG. 16 is a sectional view taken along line 16-16 of FIG. 15; and

FIG. 17 is a sectional view taken along line 17-17 of FIG. 15.

DETAILED DESCRIPTION OF THE PRESENT INVENTION

Figure 1:
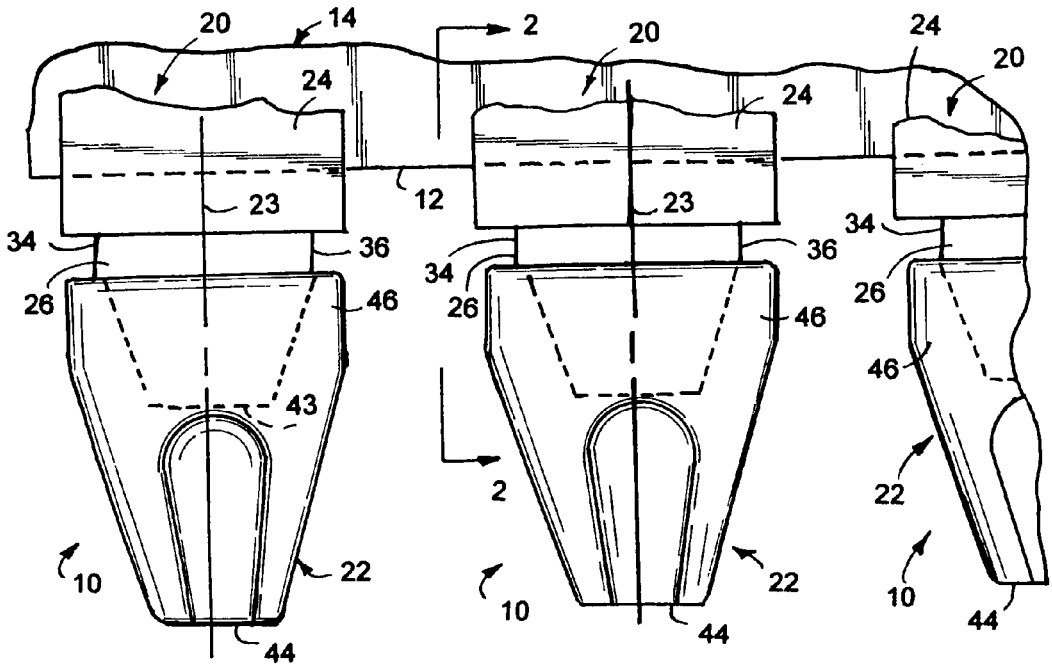
FIG. 1 is a top plan view of one form of a two-part digging system extending forward from an edge or lip of an ground working implement.

While the present invention is susceptible of embodiment in multiple forms, there are shown in the drawings and will hereinafter be described various preferred embodiments of the present invention with the understanding the present disclosure is to be considered as setting forth exemplifications of the invention which are not intended to limit the invention to the specific embodiments illustrated and described.

Referring now to the drawings, wherein like reference numerals indicate like parts throughout the several views, there is shown in FIG. 1 a series of two-part digging assemblies, with each assembly being identified generally by reference numeral 10. As is typical, the two-part assemblies are arranged in horizontally proximate relation relative to each other across a forward edge or lip 12 of a ground engaging implement such as a bucket or the like 14. It should be appreciated that during operation, the bucket or shovel 14, to which the two-part system 10 is attached moves both vertically and horizontally. The purpose of each two-part assembly 10 is to fracture the ground in advance of the bucket edge 12. In this regard, each two-part assembly 10 extends forward from the forward edge or lip 12 of the implement 14.

Each two-part assembly 10 includes a support 20 and a replaceable earth working part or tool 22 which are generally aligned relative to each other along an axis 23. In the illustrated embodiment, the replaceable part or tool 22 of each assembly 10 is shown as a digging tooth. It should be appreciated, however, the replaceable earth working tool 22 can take a myriad of different designs other than a tooth, i.e., a ripper, lip shroud, wear cap, etc.

Figure 2:
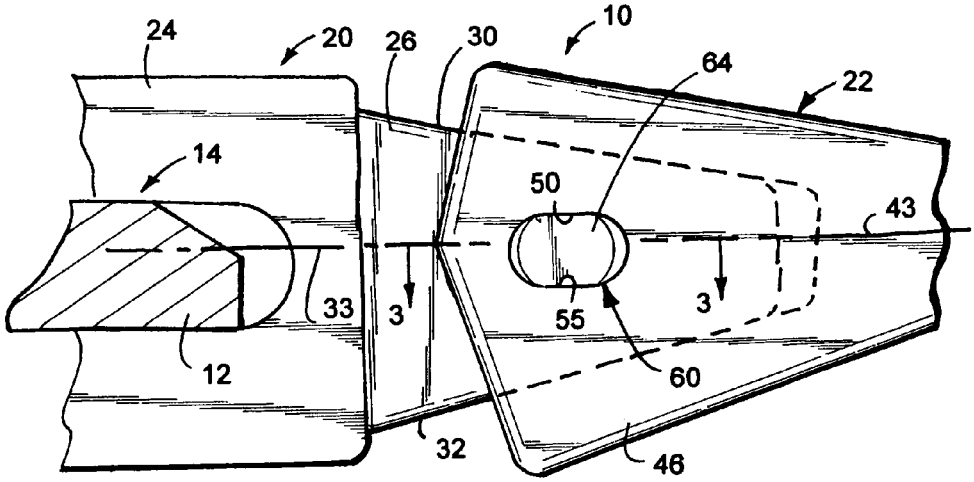
FIG. 2 is a sectional view taken along line 2-2 of FIG. 1.

In that embodiment shown in FIG. 2, the adapter 20 has an elongated free ended configuration and includes a conventional base portion 24 and an elongated nose portion 26 extending forward from the base portion 24. Base portion 24 is configured for suitable attachment to the forward lip or edge 12 of the ground engaging apparatus or bucket 14. As is conventional, the tool or tooth 22 fits endwise along and about the adapter nose portion 26.

Although a specifically configured nose portion 26 for the adapter 20 is illustrated in the drawings and will hereinafter be described, it should be appreciated the principals of this invention equally apply to adapters which are configured other than as illustrated in the drawings and hereinafter described. In the preferred form, the nose portion 26 of the adapter 20 has a forward tapered configuration including angularly converging top and bottom exterior surfaces 30 and 32, respectively, (FIG. 2). In the illustrated embodiment, the top and bottom surfaces 30 and 32, respectively, are disposed to opposed vertical sides of a longitudinal centerline 33 of the adapter 20. In the illustrated embodiment, each adapter 20 further includes a pair of laterally spaced side surfaces 34 and 36 (FIG. 1) arranged to opposite sides of the axis 33.

Figure 3:
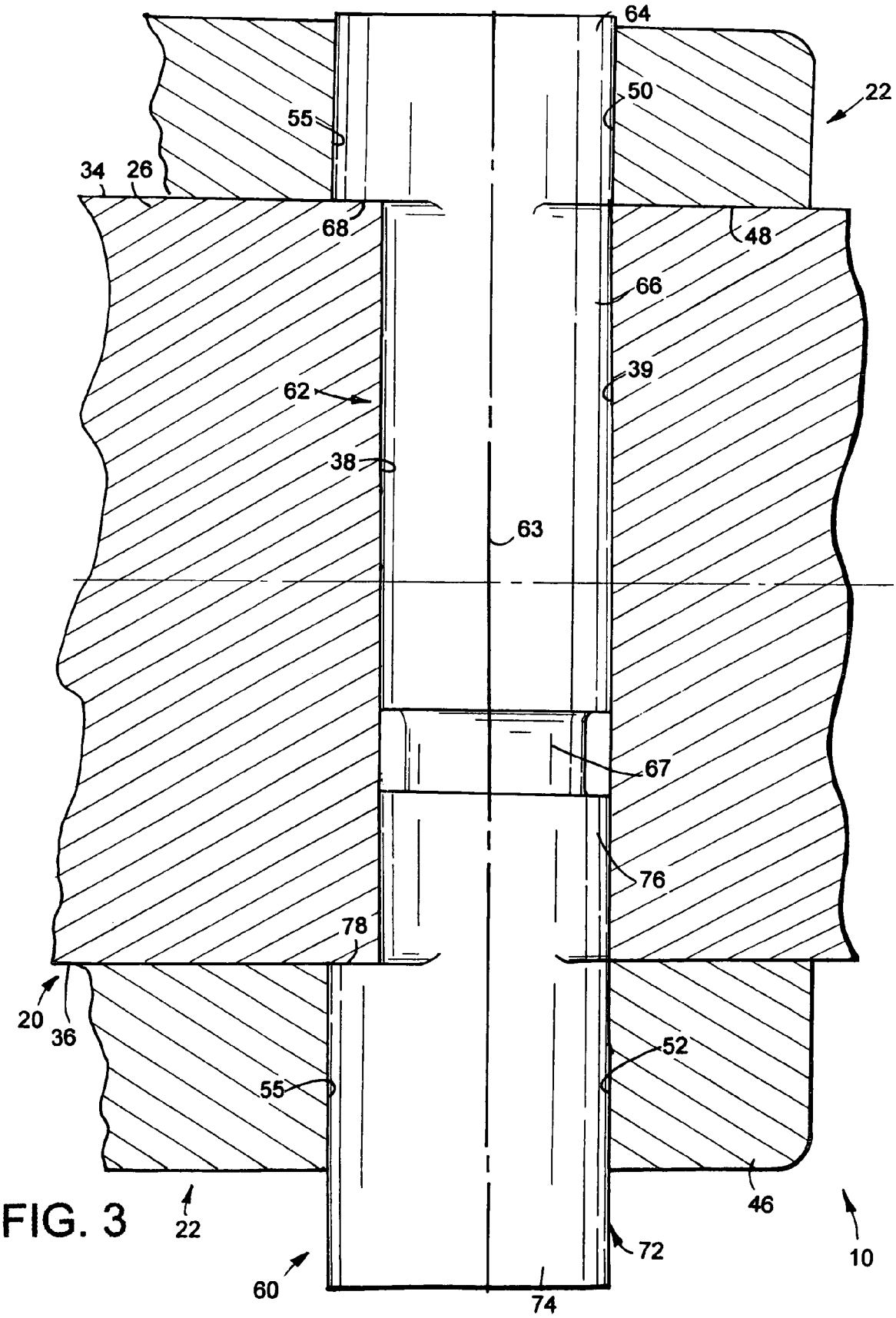
FIG. 3 is an enlarged sectional view taken along line 3-3 of FIG. 2.

As shown in FIG. 3, the nose portion 26 of the support or adapter 20 defines a pin receiving opening or throughbore 38 disposed toward the rear of the nose portion 26. In the form shown, the pin receiving opening or throughbore 38 opens to the opposed sides 34, 36 of the support or adapter 20. In the form shown, the pin receiving opening or throughbore 38 has a closed marginal edge defining an inner surface 39. Moreover, in the form shown, the inner surface 39 of opening 38 has a generally circular cross-sectional profile or configuration.

In the embodiment illustrated in FIG. 1, the replaceable earth working tool or digging tooth 22 of each two-part assembly 10 has an elongated wedge shape with a longitudinal centerline 43 (FIG. 2) arranged in general alignment with the longitudinal centerline 33 of the respective support 20. The earth working tool or digging tooth 22 has a forward end portion 44, operative to engage the material being worked, and a rear end portion 46 configured to readily allow connection of the tool or tooth 22 to the adapter 20.

As shown in FIG. 3, the rear end portion 46 of the replacement tool or tooth 22 is configured with multiple exterior sides which combine to define an open ended blind cavity 48 therebetween. Suffice it to say, the multiple exterior sides of the replacement tool can take on a myriad of different shapes as long as the cross-sectional configuration of the cavity or pocket 48 is configured to receive and accommodate the nose portion 26 of the adapter 20 and whereby the conjuncture between the adapter 20 and the replacement part or tool 22 minimizes movement between component parts of the two-part assembly 10 after the component parts 20, 22 are arranged in operable combination relative to each other.

In the embodiment illustrated in FIG. 3, two of the multiple exterior sides of the tool or tooth 22 define a pair of axially aligned openings 50 and 52 disposed to opposite sides of the cavity 48. The openings 50 and 52 generally correspond in configuration relative to each other and, thus, only opening 50 will be described in detail.

In that embodiment shown in FIG. 2, the tooth opening 50 is generally elongated in a direction extending generally parallel to the longitudinal centerline 43 of the tool 22 and has a closed marginal edge defining an inner surface 55. Notably, and as shown in FIG. 3, the axially aligned tooth openings 50, 52 are arranged along an axis disposed in intersecting relation with the cavity 48 defined by the tooth 22. As will be appreciated from the description below, the configuration of each opening 50, 52 can be other than that shown without detracting or departing from the spirit and scope of the invention.

Figure 4:
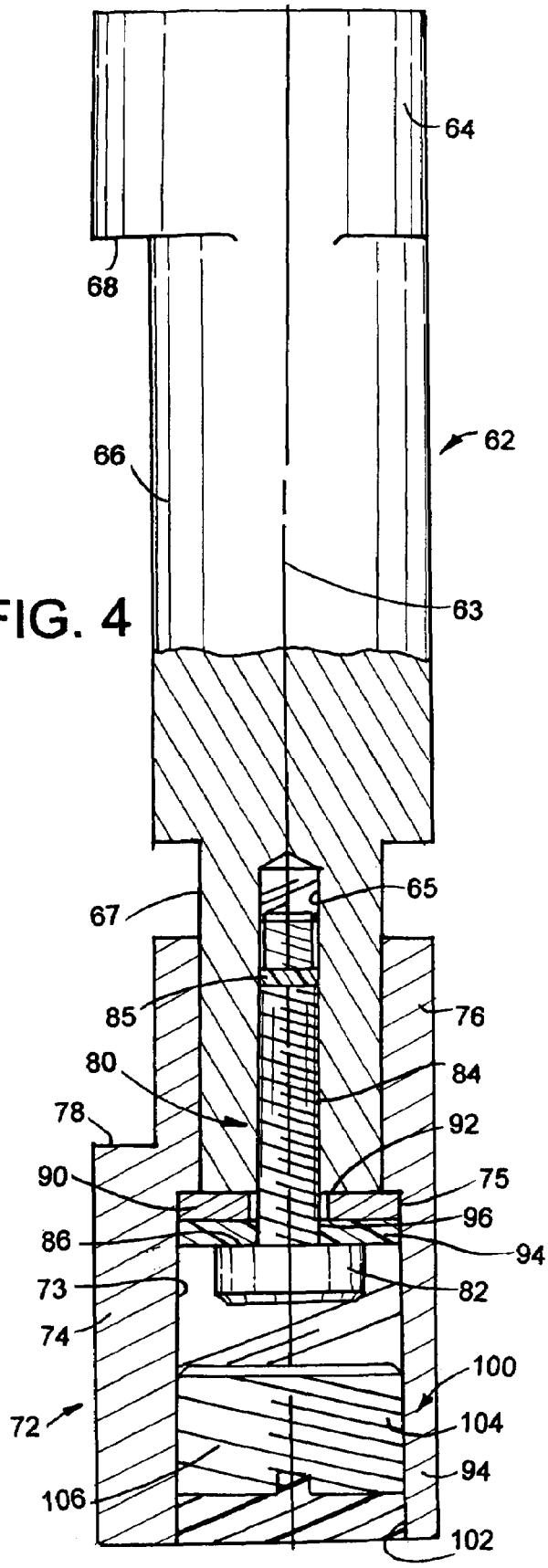
FIG. 4 is a plan view, with parts broken away, of one form of pin assembly embodying principals of the present invention.
Figure 6:
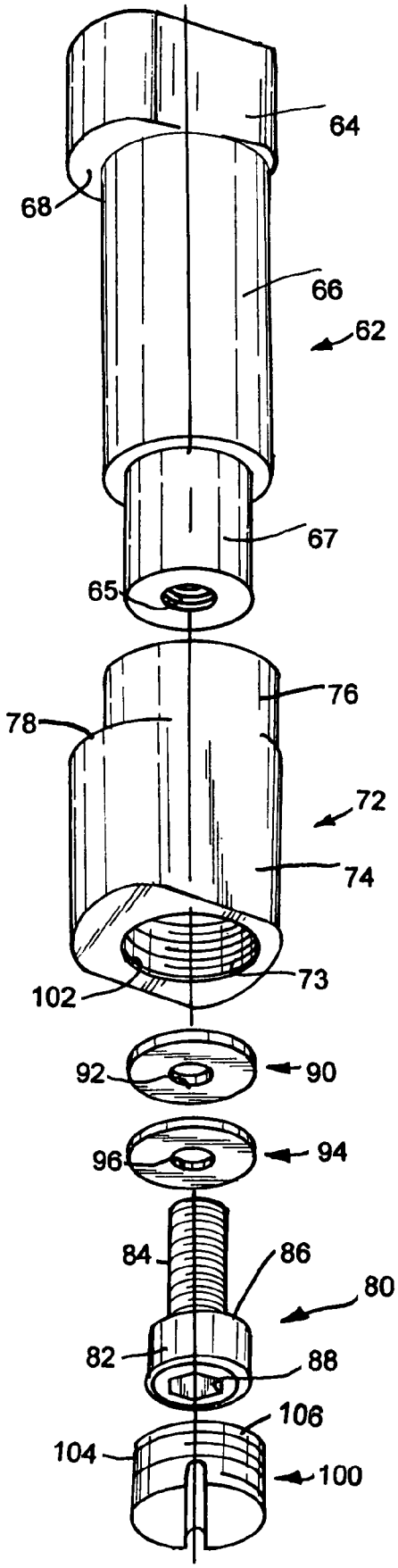
FIG. 6 is a perspective view of the pin assembly illustrated in FIG. 4.

In accordance with the present invention, a pin assembly 60 is provided for releasably maintaining the adapter 20 and replaceable tool or tooth 22 in operable combination relative to each other. As illustrated in FIGS. 3 and 4, pin assembly 60 includes a multipiece structure comprised of a pair of retaining pins 62 and 72 which, when assembled relative to each other, are axially aligned relative to each other along an axis 63.

As shown, pin 62 includes an enlarged head portion 64 and an axially elongated shaft or shank portion 66. Suffice it to say, the opening 50 in tooth 22 is configured to allow the shank portion 66 of pin 62 to pass endwise therethrough while the head portion 64 of pin 62 remains releasably fitted within the opening 50 in the tooth 22 so as to prevent pin assembly 60 from rotating about axis 63 (FIG. 3). In the exemplary embodiment, the pin head portion 64 is configured to complement the configuration of the opening 50. In this regard, it should be appreciated, the configuration of either the tooth opening 50 or the head portion 64 of pin 62 can be changed from that shown as long as the inner surface 55 of the tooth opening 50 and the outer surface of the head portion 64 of pin 62 cooperate relative to each other to prevent rotation of the pin assembly 60 about axis 63 following insertion of the pin assembly 60 into operable combination with the support 20 and tool 22. As shown, head portion 64 of pin 62 is too large to fit within the pin receiving opening or bore 38 defined in the nose portion 26 of adapter 20.

In the embodiment illustrated in FIG. 3, the shank portion 66 of pin 62 is axially elongated for a distance somewhat less than a distance between opposed sides 34, 36 of the adapter 20. Moreover, the shank portion 66 of pin 62 has a cross-sectional configuration which, preferably, complements the cross-sectional configuration of the pin receiving opening 38 in the support 20. In the exemplary embodiment, the pin receiving opening 38 in the support 20 has a generally circular cross-sectional configuration. Accordingly, the shaft portion 66 of pin 62 will likewise preferably have a generally circular cross-sectional configuration. Suffice it to say, after pin 62 is axially inserted into the pin receiving opening 38 in the support 20 at least a portion of the outer surface of the shank portion 66 of pin 62 operably engages with a lengthwise section of the inner surface 39 of the pin receiving bore 38 in the support 20. Moreover, and as shown in FIGS. 3 and 4, the enlarged head portion 64 and shaft portion 66 of pin 62 are sized relative to each other such that a radial shoulder or step 68 is provided at the juncture of the two portions 64 and 66.

Figure 5:
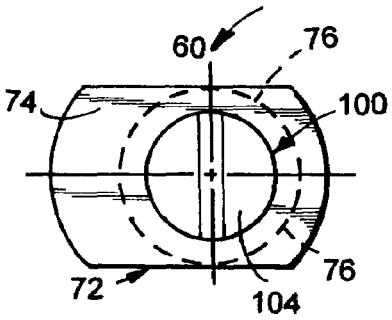
FIG. 5 is an end view of the pin assembly illustrated in FIG. 4.

As shown in FIG. 3, retaining pin 72 likewise includes an enlarged head portion 74 and a shank or shaft portion 76. The opening 52 on the side of the tooth 22 opposite from opening 50 is configured to allow the shank portion 76 of pin 72 to pass endwise therethrough while the enlarged head portion 74 of pin 72 is configured to fit within the tooth opening 52 and thereafter prevent pin assembly 60 from turning about axis 63. In the illustrated embodiment, head portion 74 of pin 72 is too large to fit within the pin receiving opening or bore 38 defined in the adapter nose portion 26. One configuration for the head portion 74 of pin 72 is illustrated in FIG. 5. As with the head portion 64 of pin 62, the configuration of head portion 74 of pin 72 preferably complements the configuration of the opening 52 in the tooth 22. As mentioned, however, it should be appreciated, the configuration of either the tooth opening 52 or the head portion 74 of pin 72 can be changed from that shown as long as at least a portion of the inner surface 55 of the tooth opening 52 and the outer surface of the head portion 74 of pin 72 can cooperate relative to each other to prevent rotation of the pin assembly 60 about axis 63 following insertion of the pin assembly 60 into operable combination with the support 20 and tool 22.

In that embodiment illustrated in FIG. 3, the shank portion 76 of pin 72 is elongated for a distance somewhat less than a distance between opposed sides 34, 36 of the adapter 20. As shown in FIG. 3, the cumulative length of the joined shank portions 66 and 76 of pins 62 and 72, respectively, is equal to or less than the length of the distance between opposed sides 34, 36 of that portion of the adapter 20 through which bore 38 passes. Moreover, the shank portion 76 of pin 72 has a cross-sectional configuration which complements the cross-sectional configuration of the pin receiving opening 38 in the support 20. As mentioned above, the pin receiving bore 38 in the support 20 preferably has a generally circular cross-sectional configuration. Accordingly, shaft portion 76 of pin 72 will likewise preferably have a generally circular cross-sectional configuration. Suffice it to say, after pin 72 is axially inserted into bore 38 in the support 20 at least a portion of the outer surface of the shank portion 76 of pin 72 operably engages with the inner surface 39 of the bore 38 in the support 20.

As shown in FIGS. 3 and 4, the enlarged head portion 74 and shank portion 76 of retaining pin 72 are sized relative to each other such that a radial shoulder or step 78 is provided at the juncture therebetween. Accordingly, after pins 62 and 72 are axially assembled relative to each other, the distance between the shoulders 68 and 78 of pins 62 and 72, respectively, is substantially equal to the distance across that portion of the adapter 12 through which the pin receiving bore 38 extends.

As shown in FIGS. 4 and 5, pin assembly 60 further includes a fastener 80 axially insertable through one of the pins 62,72 and which forms a threaded juncture with the other of the two pins 62, 72 for operably securing distal ends of the pins 62 and 72 in an operable but releasable combination relative to each other whereby maintaining the support 20 and tool 22 in operable relation relative to each other. In one form, fastener 80 includes an enlarged head portion 82 with an externally threaded shank portion 84. Fastener 80 further defines a radial shoulder 86 at the conjuncture of the head portion 82 and shank portion 84. At its free end, head portion 82 of fastener 80 is suitably configured to releasably accommodate a tool (not shown) used to forcibly turn fastener 80 about axis 63.

Turning to the embodiment illustrated by way of example in FIG. 4, pin 72 of assembly 60 defines an axial counterbore 73 opening to opposite ends of pin 72. Counterbore 73 defines a radial step 75 along the length thereof. According to this embodiment, pin 62 defines, at the end opposite from head portion 64, an internally threaded bore 65 for receiving and establishing the threaded juncture with the threads 84 of fastener 80. In a preferred form, the threads within the bore 65 of pin 62 and on the shank portion 84 of fastener 80 have a relatively "fine" pitch thereto to facilitate the holding power thereof. Moreover, and as shown in FIG. 4, the threaded shank portion 84 of fastener 80 preferably includes structure in the form of a conventional non-metallic insert 85 for inhibiting inadvertent rotation of the fastener 80 after the pins 62 and 72 of assembly 60 are secured in operable combination relative to each other.

As shown in FIG. 4, the distal ends of pins 62 and 72 are arranged in operable combination relative to each other to enhance the strength and flexural rigidity of the pin assembly 60 while reducing stress on the fastener 80. In the embodiment shown, the smaller diameter of the counterbore 73 opens to that end of pin 72 opposite from the enlarged head portion 74. In the embodiment illustrated in FIG. 4, and after being installed within bore 38 of the adapter 20, the free or distal ends of pins 62, 72 are arranged in telescoping relation relative to each other In that embodiment shown by way of example in FIG. 4, at that end opposite from head portion 64, pin 62 defines a stub shaft portion 67 having a smaller diameter than the remainder of the shank portion 66. The stub shaft portion 67 of pin 62 has an outside diameter equal to or slightly less than the inside diameter of the smaller diameter of the counterbore 73 defined by pin 72. As such, when the distal ends of pins 62, 72 are brought together from opposite axial direction within bore 38 of the adapter 20, a lengthwise portion of the stub shaft portion 67 of pin 62 telescopically fits axially within the smaller diameter portion of the counterbore 73 of pin 72. Accordingly, the distance between the shoulders 68 and 78 of pins 62 and 72, respectively, can be changed to accommodate different adapters 20 while the confronting end sections of the pins 62, 72 remain in operable combination relative to each other.

In one form, pin assembly 60 also includes a rigid ring or washer 90 axially accommodated within the larger diameter portion of the counterbore 73 of pin 72. As shown in FIG. 4, the rigid washer 90 defines a generally centralized opening or hole 92 having a diameter greater than the diameter of the external threaded shank portion 84 of fastener 80 but smaller than the diameter of the enlarged head portion 82 of fastener 80. During operation, the washer or ring 90 serves as a limit stop for the fastener 80.

Preferably, pin assembly 60 also includes seal structure 92 for inhibiting contaminants including moisture, dust, and dirt from interfering with proper operation of fastener 80 and pin 62 threadably engagable with fastener 80. In a preferred embodiment, seal structure 92 includes a ring or washer 94, preferably fabricated from elastomeric material. As shown in FIG. 4, washer 94 is preferably seated between washer 90 and the shoulder 86 on fastener 80. As used herein and throughout, the term "elastomeric material" means and refers to: natural rubber, synthetic rubber, plastic, polyvinyl, polymide materials, nylon, composites, polyethylene, ultra-high molecular weight materials, and any of numerous organic, synthetic materials which can serve to "seal" and protect the juncture established between fastener 80 and pin 62 of assembly 60. In the illustrated embodiment, ring or washer 94 is provided with a generally centralized opening or hole 96 having a diameter generally equal to or slightly larger than the diameter of the shank portion 84 of fastener 80 but smaller than the diameter of the enlarged head portion 82 of fastener 80.

As will be appreciated, and after the shank portion 84 of fastener 80 operably engages with the internally threaded bore 65 of pin 62, rotation of the fastener 80 in a first direction causes pins 62 and 72 to be axially drawn toward each other until the shoulders 68 and 78 on the pins 62 and 72, respectively, tightly clamp against their confronting side surfaces on the adapter 20. As the pins 62, 72 are tightened against the adapter 20, the elastomeric ring or washer 94 is squeezed by the head portion 82 of fastener 80 pressing there against it and the elastomer of washer 94 tends to flow through the opening 96 in the washer 94 and around the fastener shank portion 84. Likewise, the squeezed elastomer of ring or washer 94 tends to flow and fill tolerance variations or voids separating the exterior surface of stub shaft portion 67 of pin 62 from the interior surface defined by the counterbore portion 73 of pin 72. As such, contaminants including small rocks, stones, dirt, dirt fines, dust, and moisture are inhibited from passing between the threaded juncture established between pin 62 and fastener 80. Of course, eliminating or reducing clogging, oxidation or rusting of the mating surfaces between the externally threaded shank portion 84 of fastener 80 and the internally threaded bore 65 of pin 62 naturally tends to facilitate rotation of the fastener 80 in a direction to effect release of the hammerless pin assembly 60.

In a most preferred embodiment, the pin through which fastener 80 passes further includes structure 100 operably associated with that pin to further inhibit dirt, debris, moisture and other contaminants from interfering with proper operation of the fastener 80. In the form illustrated in FIG. 4, the larger end of the counterbore 73 defined by pin 72 is provided with internal threading 102 along at least a lengthwise portion thereof. Preferably, a non-ferrous or non-metallic plug 104 having external threading 106 is also provided as part of the pin assembly 60. The end of plug 104, configured for exposure to the open end of the counterbore 73, is suitably configured such that a tool (not shown) can be releasably inserted thereinto to facilitate rotation of the plug 104 relative to the pin 72. When arranged in operable combination with pin 72, plug 104 inhibits contaminants from adversely effecting the threaded juncture established between pin 62 and fastener 80. Again, and as will be appreciated by those skilled in the art, the ability to maintain the threaded juncture between pin 62 and fastener 80 substantially free from contaminants significantly reduces the likelihood of clogging, oxidation or rusting of the mating surfaces between the externally threaded shank portion 84 of fastener 80 and the internally threaded bore 65 defined by pin 62.

Figure 7:
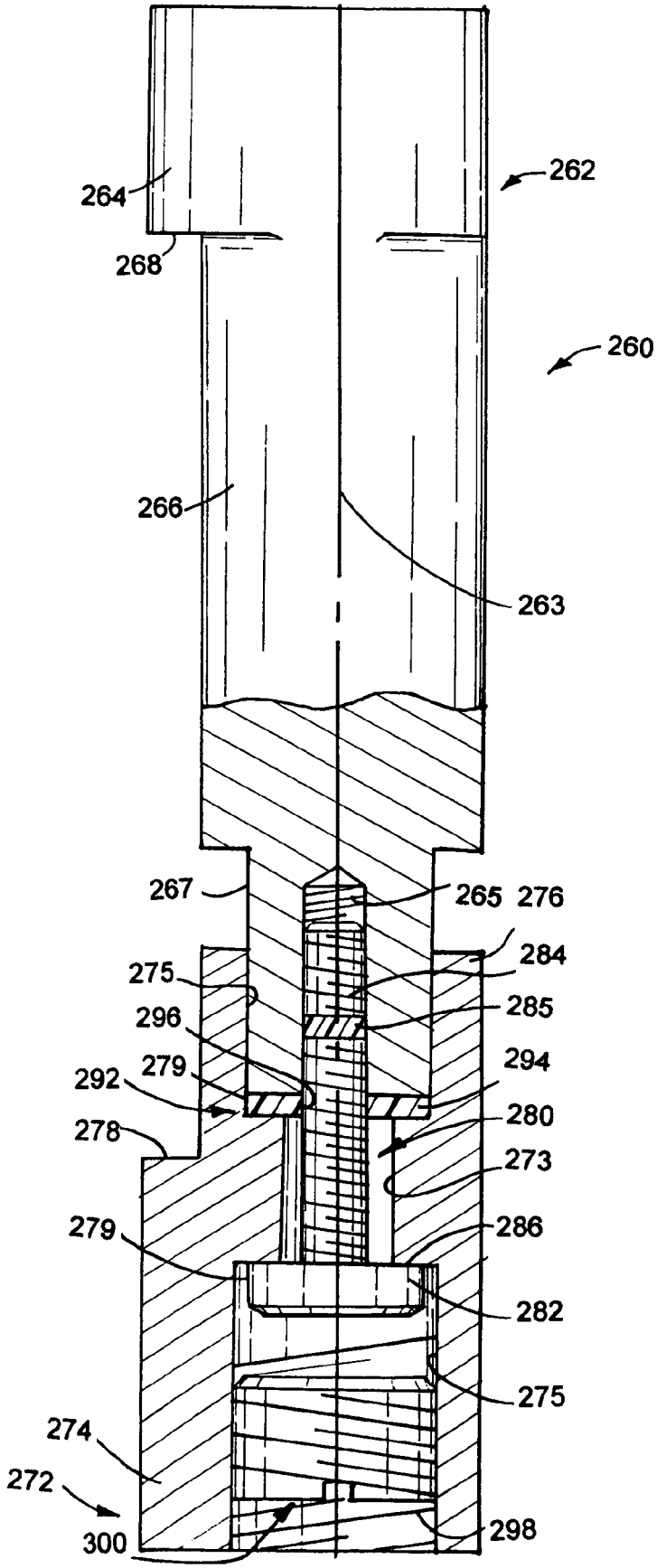
FIG. 7 is a plan view similar to FIG. 4, with parts broken away, showing an alternative form of pin assembly embodying principals of the present invention.

FIG. 7 illustrates an alternative form for the pin assembly. This form of pin assembly is designated generally by reference numeral 260. The elements of this alternative pin assembly that are functionally analogous to those components discussed above regarding pin assembly 60 are designated by similar reference numerals to those listed above.

As shown in FIG. 7, pin assembly 260 includes a multiple piece structure comprising a pair of retaining pin 262 and 272 which, when assembled, are axially aligned relative to each other along axis 263. As shown, pin 262 includes an enlarged head portion 264 and an axially elongated shank portion 266. The head portion 264 of pin 262 is configured to fit endwise within the opening 50 in the tooth 22 and thereafter prevent pin assembly 260 from rotating about axis 63. Suffice it to say, the configuration of head portion 264 is similar to that of head portion 64 discussed above. As shown, the head portion 264 of pin 262 is too large to fit within the pin receiving opening or bore 38 defined in the nose portion 26 of adapter 20 (FIG. 3).

Like shank portion 66 of pin 62, the shank portion 266 of pin 262 is elongated for a distance somewhat less than a distance between opposed sides 34, 36 of the adapter 20 (FIG. 1) and preferably has a generally circular cross-sectional configuration which complements the cross-sectional configuration of the pin receiving bore 38 in support 20. Moreover, and as shown in FIG. 7, the enlarged head portion 264 and shank portion 266 of pin 262 are sized relative to each other such that a radial shoulder or step 268 is provided at the juncture of the two portions 264 and 266 for engagement with the side of the adapter 20.

Retaining pin 272 also includes an enlarged head portion 274 and a shank portion 276. The head portion 274 of pin 272 is configured to fit within the tooth opening 52 and thereafter prevent pin assembly 260 from turning about axis 263 but is to large to fit within the pin receiving bore 38 defined in the nose portion 26 of adapter 20. Suffice it to say, the configuration of the head portion 274 complements the configuration of the opening 52 in the tooth 22. Following insertion of the pin 272 into operable combination with the support 20 and tool 22, at least a portion of the outer surface of head portion 274 of pin 272 and the tooth opening 52 cooperate relative to each other to prevent rotation of the pin assembly 260 about axis 263.

Like shank portion 76 of pin 72, shank portion 276 of pin 272 is elongated for a distance somewhat less than a distance between opposed sides 34, 36 of the adapter 20 (FIG. 1) and has a cross-sectional configuration which complements the cross-sectional configuration of the pin receiving bore 38 in the support 20. Suffice it to say, after pin 272 is axially inserted into the pin receiving bore 38 in the support 20 at least a portion of the outer surface of the shank portion 276 of pin 172 will operably engage with the inner surface 39 of the pin receiving bore 38 in the support 20.

As shown in FIG. 7, head portion 274 and shank portion 276 of retaining pin 272 are sized relative to each other such that a shoulder 278 is provided at the juncture therebetween. Accordingly, after pins 262 and 272 are axially assembled relative to each other, the distance between the shoulders 268 and 278 of pins 262 and 272, respectively, is substantially equal to the distance across that portion of the adapter 12 through which the pin receiving bore 38 extends.

Pin assembly 260 further includes a fastener 280 for drawing the pins 262 and 272 axially toward each other and for, ultimately, securing the pins 262 and 272 in operable but releasable combination relative to each other. Fastener 280 preferably includes an enlarged head portion 282 with an externally threaded shank portion 284 extending therefrom. In one form, fastener 280 further defines a radial shoulder 286 at the conjuncture of the head portion 282 and shank portion 284. At its free end, head portion 282 of fastener 280 is preferably configured to releasably accommodate a suitable tool used to forcibly turn fastener 280 about axis 263.

In the form shown in FIG. 7, pin 272 also defines a preferably coaxial bore 273 open at opposite ends thereof. Bore 273 is configured with axially spaced counterbores 275 and 275' opening to opposite ends of pin 272. As shown in FIG. 7, each counterbore 275, 275' has a diameter larger than the diameter of axial bore 273 and, as such, each counterbore 275 and 275' defines a radial step or shoulder 279 and 279', respectively, at the juncture with bore 273.

As shown, pin 262 defines, at the end opposite from head portion 264, an internally threaded bore 265 for receiving and accommodating the threaded shank portion 284 of fastener 280. In a preferred form, the threads within the bore 265 of pin 262 and on the shank portion 284 of fastener 280 have a relatively "fine" pitch thereto to facilitate the holding power thereof. Moreover, and as shown in FIG. 7, the threaded shank portion 284 of fastener 280 preferably includes structure in the form of a conventional non-metallic insert 285 for inhibiting inadvertent rotation of the fastener 280 after the pins 262 and 272 of assembly 260 are secured in operable combination relative to each other.

The free or distal ends of pins 262, 272 are arranged in operable combination relative to each other to enhance the strength and flexural rigidity of the pin assembly 260 while reducing stress on fastener 280. In the embodiment illustrated in FIG. 7, and after being installed within bore 38 of the adapter 20, the free or distal ends of pins 262, 272 of assembly 260 are arranged in telescoping relation relative to each other.

In the embodiment shown by way of example in FIG. 7, pin 262 preferably defines a stub shaft portion 267 of smaller diameter than the remainder of shank portion 266 and axially extending from the end of pin 262 opposite from head portion 264. Shaft portion 267 of pin 262 has an outside diameter equal to or slightly less than the inside diameter of the counterbore 275 defined by pin 272. As such, when the ends of pins 262, 272 are assembled relative to each other, a lengthwise portion of the stub shaft portion 267 of pin 262 telescopically fits axially within the counterbore 275 of pin 272. Accordingly, the distance between the shoulders 268, 278 of pins 262, 272, respectively, can be changed to accommodate different adapters 20 while maintaining the confronting end portions of the pins 262, 272 in operable combination relative to each other.

Preferably, pin assembly 260 also includes seal structure 292 for inhibiting contaminants including moisture, dust, and dirt from interfering with proper operation of fastener 280 and pin 262 threadably engagable with fastener 280. In a preferred embodiment, seal structure 292 includes a ring or washer 294, preferably fabricated from elastomeric material, disposed between the distal end of the stub shaft portion 267 of pin 262 and the radial step or shoulder 276 defined by pin 272. As used herein and throughout, the term "elastomeric material" means and refers to: natural rubber, synthetic rubber, plastic, polyvinyl, polymide materials, nylon, composites, polyethylene, ultrahigh molecular weight materials, and any of numerous organic, synthetic materials. In the illustrated embodiment, the ring or washer 294 is provided with a generally centralized opening or hole 296 having a diameter generally equal to or slightly larger than the diameter of the shank portion 284 of fastener 280 but smaller than the diameter of the enlarged head portion 282 of fastener 280.

As will be appreciated, and after the shank portion 284 of fastener 280 operably engages with the threaded bore 265 of pin 262, the fastener 280 will turn freely until the shoulder 286 on the enlarged head portion 282 of fastener 280 engages with the radial shoulder or step 279' defined by counterbore 275'. Thereafter, rotation of the fastener 280 in a first direction causes pins 262 and 272 to be drawn toward each other until shoulders 268 and 278 on pins 262 and 272, respectively, tightly clamp against their confronting side surfaces on the adapter 20. As pins 262, 272 are drawn toward each other, the elastomeric member 294 is squeezed between the end of stub shaft portion 267 of pin 262 and the shoulder 279 defined by counterbore 275 in pin 272. As a result of this squeezing action, the elastomer of washer 294 tends to flow and, ultimately, fill tolerance variations or voids separating the exterior surface of shaft portion 267 of pin 262 from the interior surface defined by the counterbore 275 of pin 272. As such, contaminants including small rocks, stones, dirt, dirt fines, dust, and moisture are inhibited from passing toward the threaded juncture established between pin 262 and fastener 280. Of course, eliminating or reducing clogging, oxidation or rusting of the mating surfaces between the threaded shank portion 284 of fastener 280 and the threaded bore 265 of pin 262 naturally tends to facilitate rotation of the fastener 280 in a direction to effect release of the pin assembly 260.

In a most preferred embodiment, the pin through which fastener 280 passes further includes structure 300 operably associated with that pin to further inhibit dirt, debris, moisture and other contaminants from interfering with proper operation of the fastener 280. Structure 300 for inhibiting dirt, debris, moisture and other contaminants from interfering with proper operation of the fastener 280 can be substantially similar to structure 100 discussed above and, thus, no further details need be provided for a complete and full understanding thereof FIGS. 8 through 12 illustrate an alternative form for the pin assembly. This form of pin assembly is designated generally by reference numeral 460. The elements of this alternative pin assembly that are functionally analogous to those components discussed above regarding pin assembly 60 are designated by similar reference numerals to those listed above.

Figure 8:
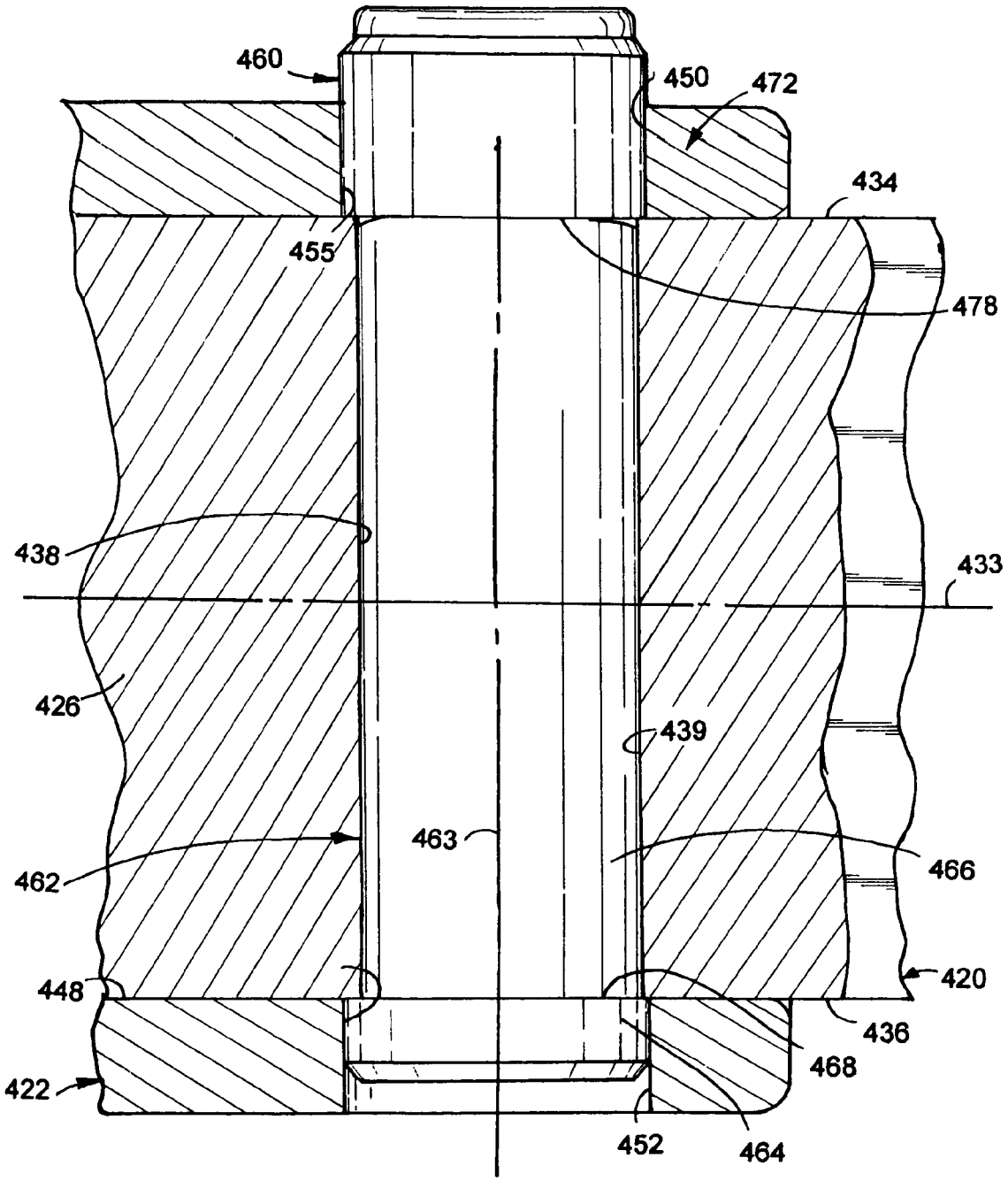
FIG. 8 is an enlarged view similar to FIG. 3 of an alternative form of pin assembly embodying principals of the present invention.

As shown in FIG. 8, pin assembly 460 is designed for use with a two-piece assembly including an adapter or support 420 and a replaceable tool or tooth 422 releasably connected to each other by the pin assembly 460. The adapter 420 and tool or tooth 422 are substantially similar to the adapter 20 and tool/tooth 22 described above with the exception of the following changes. The pin receiving opening or bore 438 defined toward the rear of the nose portion 426, while opening to opposed sides 434, 436 of the adapter 420, has a closed marginal edge defining an inner surface 439 having a generally elliptical-like profile or configuration along the length thereof rather than a circular cross-sectional configuration as described above regarding bore 38. In one form, the elliptical-like profile or configuration of the pin receiving bore 438 is preferably elongated in a direction generally paralleling the longitudinal centerline 433 of the adapter 420. Moreover, the axially aligned openings 450 and 452 on opposed sides of the cavity 448 and defined by the tool/tooth 422 each have a closed marginal edge defining an inner surface 455 and are each generally circular in cross-sectional configuration rather than the elongated cross-sectional shape illustrated in FIG. 2.

In the example shown in FIG. 8, pin assembly 460 includes a multiple piece structure including a pair of retaining pins 462 and 472 which, when assembled, are axially aligned relative to each other along axis 463. As shown, pin 462 includes an enlarged head portion 464 and an axially elongated shank portion 466. Head portion 464 of pin 462 is configured to fit within the opening 452 in the tooth 422. As shown, however, the head portion 464 of pin 462 is too large to fit within the pin receiving opening or bore 438 defined in the nose portion 426 of adapter 420.

Figure 11:
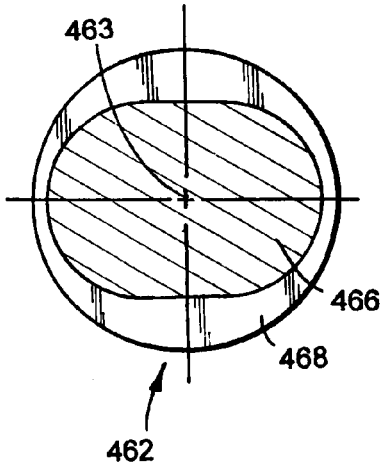
FIG. 11 is a sectional view taken along line 11-11 of FIG. 9.

To add rigidity to the pin assembly 460, the shank portion 466 of pin 462 is axially elongated for a distance substantially equal to the distance between opposed sides 434, 436 of the adapter 420. As shown in FIG. 11, shank portion 466 of pin 462 preferably has a generally elliptical-like cross-sectional configuration complementary to the cross-sectional configuration of the pin receiving bore 438 in support 420 (FIG. 8). Suffice it to say, the shank portion 466 of pin 462 is sized to endwise pass through the opening 452 in the tool/tooth 422 and is configured to slidably fit within and operably engage at least a portion of the inner surface 439 of the bore 438 in the adapter 420 while preventing pin assembly 460 from turning about axis 463. Moreover, and as shown in FIG. 8, the enlarged head portion 464 and shank portion 466 of pin 462 are sized relative to each other such that a radial shoulder or step 468 is provided at the juncture of the two portions 464 and 466 for engagement with the side of the adapter 420.

Retaining pin 472 also includes an enlarged head portion 474 and a shank portion 476. The head portion 474 of pin 472 is too large to fit within the pin receiving bore 438 defined in the nose portion 426 of adapter 420. Suffice it to say, the cross-sectional configuration of the head portion 474 complements the cross-sectional configuration of the opening 450 in the tooth 422.

Figure 9:
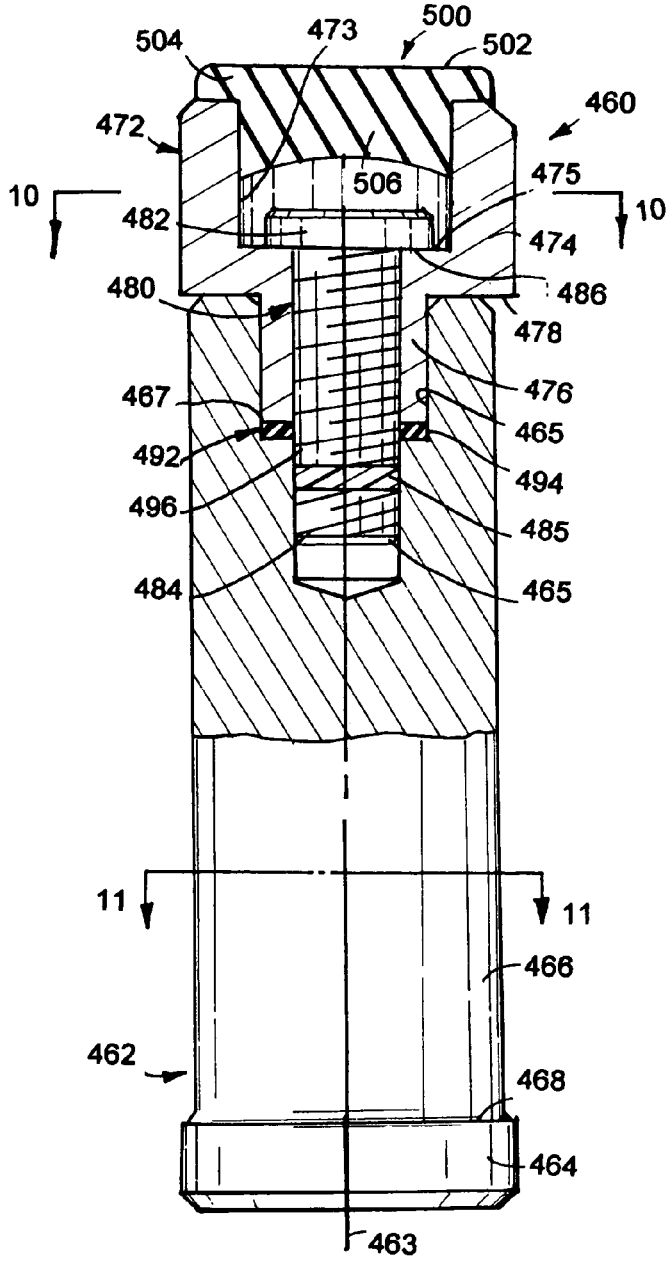
FIG. 9 is a plan view of the pin assembly illustrated in FIG. 8 with parts broken away to show details of the pin assembly.
Figure 12:
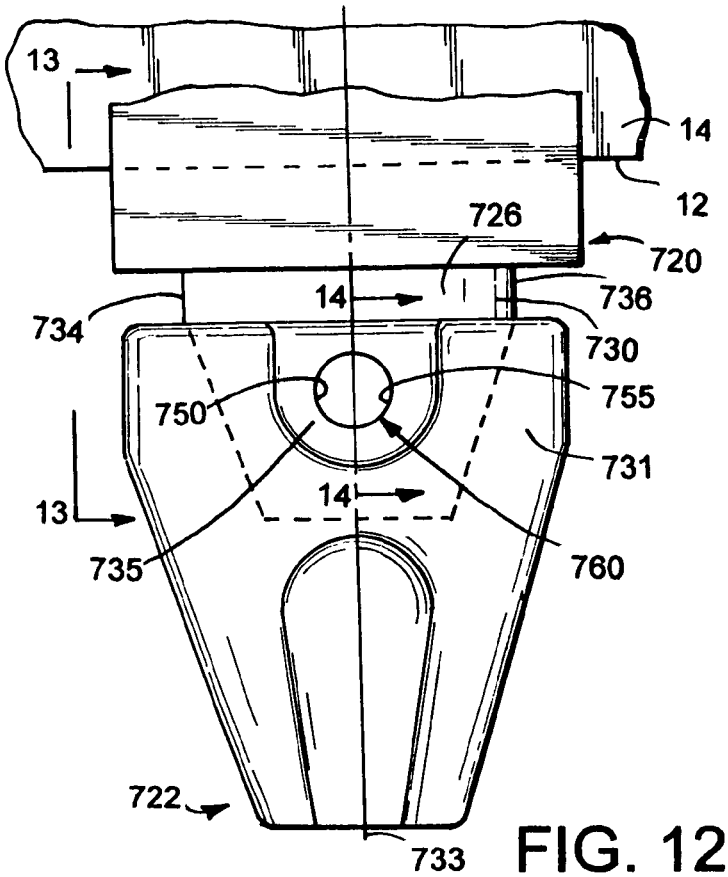
FIG. 12 is a top plan view of another form of a two-part digging system extending forward from an edge or lip of an ground working implement.

As shown in FIGS. 8 and 9, the head portion 474 and shank portion 476 of assembly 472 are sized relative to each other such that a shoulder 478 is provided at the juncture therebetween. Accordingly, and after pins 462 and 472 are axially assembled relative to each other, the distance between the shoulders 468 and 478 of pins 462 and 472, respectively, is substantially equal to the distance across that portion of the adapter 420 through which the pin receiving bore 438 extends.

Pin assembly 460 further includes a fastener 480 for drawing the pins 462 and 472 axially toward each other and for, ultimately, securing the pins 462 and 472 in operable but releasable combination relative to each other. As shown in FIG. 9, fastener 480 preferably includes an enlarged head portion 482 with an externally threaded shank portion 484 extending therefrom. Fastener 480 preferably defines a radial shoulder 486 at the conjuncture of the head portion 482 and shank portion 484. The head portion 482 of fastener 480 is preferably configured to releasably accommodate a suitable tool (not shown) used to turn fastener 480 about axis 463.

Figure 10:
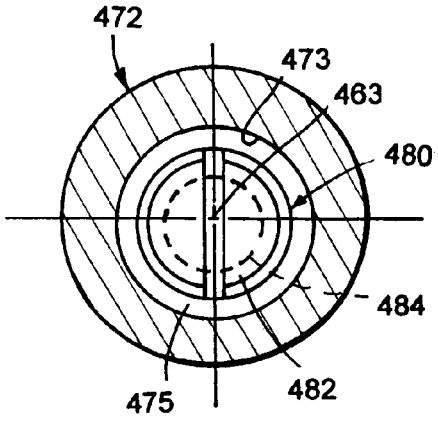
FIG. 10 is a sectional view taken along line 10-10 of FIG. 9.

In the form shown in FIGS. 9 and 10, pin 472 defines a preferably coaxial counterbore 473 open at opposite ends thereof. Counterbore 473 defines a radial step 475 along the length thereof. According to this embodiment, pin 462 defines, at the end opposite from head portion 464, a counterbore 465 including an internally threaded bore 465' for receiving and establishing a threaded juncture with the threaded shank portion 484 of fastener 480. In a preferred form, the threads within the bore 465 of pin 462 and on the shank portion 484 of fastener 480 have a relatively "fine" pitch thereto to facilitate the holding power thereof. Moreover, and as shown in FIG. 9, the threaded shank portion 484 of fastener 480 preferably includes structure in the form of a conventional non-metallic insert 485 for inhibiting inadvertent rotation of the fastener 480 after the pins 462 and 472 of assembly 460 are secured in operable combination relative to each other.

As shown in FIG. 9, the distal ends of the pins 462 and 472 of assembly 460 are arranged in operable combination relative to each other to enhance the strength and flexural rigidity of the pin assembly 460 while reducing stress on the fastener 480. The larger diameter end of the counterbore 465 opens to the distal end of pin 462 and forms a radial step or shoulder 467 with the smaller diameter and threaded end of the counterbore 465. In the embodiment illustrated in FIG. 9, and after being installed within bore 438 of the adapter 420, the free or distal ends of pins 462, 472 are arranged in telescoping relation relative to each other In the exemplary embodiment shown in FIG. 9, shank portion 476 of pin 472 has an outside diameter equal to or slightly less than the inside diameter of the larger end of the counterbore 465 defined by pin 462. As such, and after the distal ends of pins 462, 472 are brought together, from opposite axial directions, within bore 438 of the adapter 420, shank portion 476 of pin 472 telescopically fits axially within the larger diameter portion of the counterbore 465 of pin 462 while allowing the shank portion 466 of pin 462 to axially extend along the majority of the length of the bore 438 defined by adapter 420. Notably, the operable combination established between the opposed distal ends of the pins 462, 472 compensates for tolerance variations between the sides 434, 436 of the adapter 420 (FIG. 8) while maintaining the confronting end sections of the pins 462, 472 in operable combination relative to each other.

Preferably, pin assembly 460 also includes seal structure 492 for inhibiting contaminants including moisture, dust, and dirt from interfering with proper operation of fastener 480 and pin 462. In a preferred embodiment, seal structure 492 includes a ring or washer 494, preferably fabricated from elastomeric material. As shown in FIG. 9, washer 494 is preferably seated between the radial shoulder 467 defined by the counterbore 465 and the distal end of the shank portion 476 of pin 472. As used herein and throughout, the term "elastomeric material" means and refers to: natural rubber, synthetic rubber, plastic, polyvinyl, polymide materials, nylon, composites, polyethylene, ultrahigh molecular weight materials, and any of numerous organic, synthetic materials which can serve to "seal" and protect the juncture established between fastener 480 and pin 462 of assembly 460. In the illustrated embodiment, ring or washer 494 is provided with a generally centralized opening or hole 496 having a diameter generally equal to or slightly larger than the diameter of the shank portion 484 of fastener 480 but smaller than the diameter of the larger diameter of the counterbore 465 opening to the distal end of pin 462.

As will be appreciated, and after shank portion 484 of fastener 480 operably engages with the threaded bore 465' portion of pin 462, rotation of the fastener 480 in a first direction causes pins 462 and 472 to be axially drawn toward each other until the shoulders 468 and 478 on the pins 462 and 472, respectively, tightly clamp against their confronting side surfaces on the adapter 420. As the pins 462, 472 are tightened against the adapter 420, the elastomeric ring or washer 494 is squeezed between the radial shoulder 467 of the counterbore 465 and the distal end of the shank portion 476 of pin 472 thus causing the elastomer of washer 494 to flow around the fastener shank portion 484. Likewise, the squeezed elastomer of ring or washer 494 tends to flow and fill tolerance variations or voids separating the exterior surface of shank portion 476 of pin 472 from the interior surface defined by the counterbore 465 of pin 462. As such, contaminants including small rocks, stones, dirt, dirt fines, dust, and moisture are inhibited from passing between the threaded juncture between pin 462 and fastener 480. Of course, eliminating or reducing clogging, oxidation or rusting of the mating surfaces between the externally threaded shank portion 484 of fastener 480 and the internally threaded bore 466 of pin 462 tends to facilitate rotation of the fastener 480 in a direction to effect release of pin assembly 60.

In a most preferred embodiment, the pin through which fastener 480 axially passes further includes structure 500 operably associated with that pin to further inhibit dirt, debris, moisture and other contaminants from interfering with proper operation of the fastener 480. The structure 500 for inhibiting dirt, debris, moisture and other contaminants from interfering with proper operation of the fastener 480 includes a releasable cap 502 sized for closing the open end of counterbore 473 in pin 472. Cap 502 is preferably fabricated from a flexible elastomeric material such as rubber, hard plastic, polyvinyl, polymide materials, nylon, composites, polyethylene, and any of numerous organic, synthetic materials. Suffice it to say, cap 502 includes a head portion 504 having a diameter equal to or larger than the diameter of the head portion 474 of pin 472. Moreover, cap 502 includes a depending shank portion 506 having a diameter equal to or slightly greater than the inside diameter of the larger diameter portion of counterbore 473. Preferably, the shank portion 506 of cap 502 is configured to be tightly pressed into the larger diameter portion of counterbore 473 whereby maintaining the cap 502 in operable combination with pin 472. As such, the head portion 504 and shank portion 506 of cap 502 inhibit dirt, debris, moisture and other contaminants from interfering with proper operation of the fastener 480.

FIGS. 13 through 17 illustrate an alternative form for the pin assembly. This form of pin assembly is designated generally by reference numeral 760. The elements of this alternative pin assembly that are functionally analogous to those components discussed above regarding pin assembly 60 are designated by similar reference numerals to those listed above.

Figure 13:
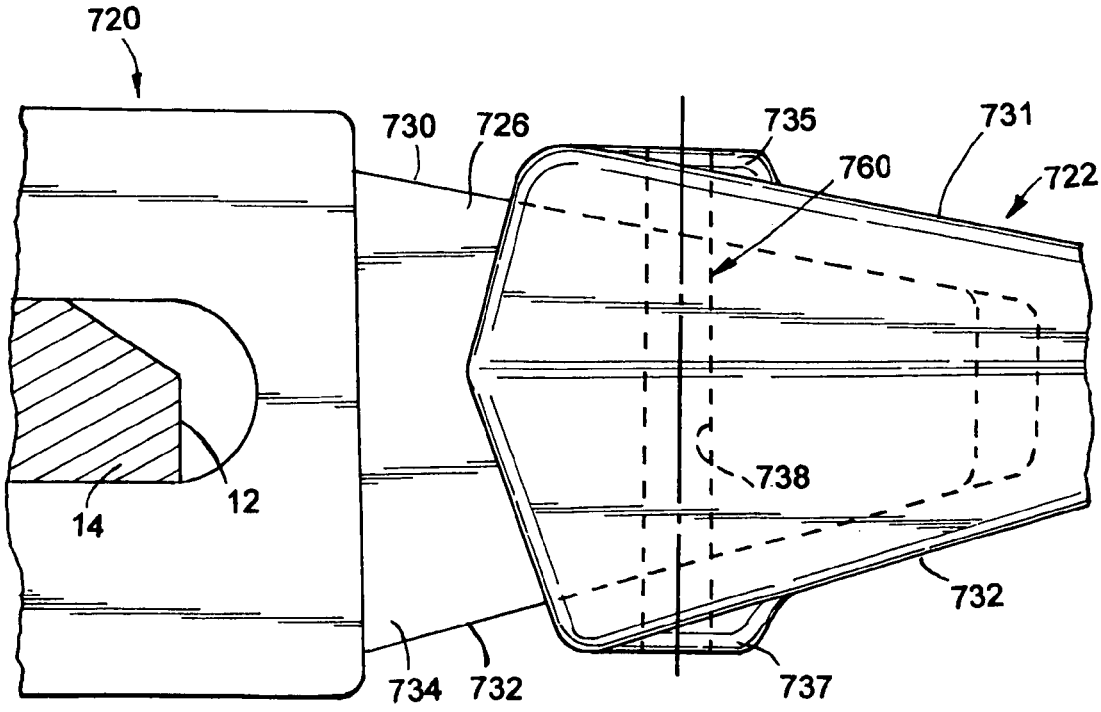
FIG. 13 is a sectional view taken along line 13-13 of FIG. 12.
Figure 14:
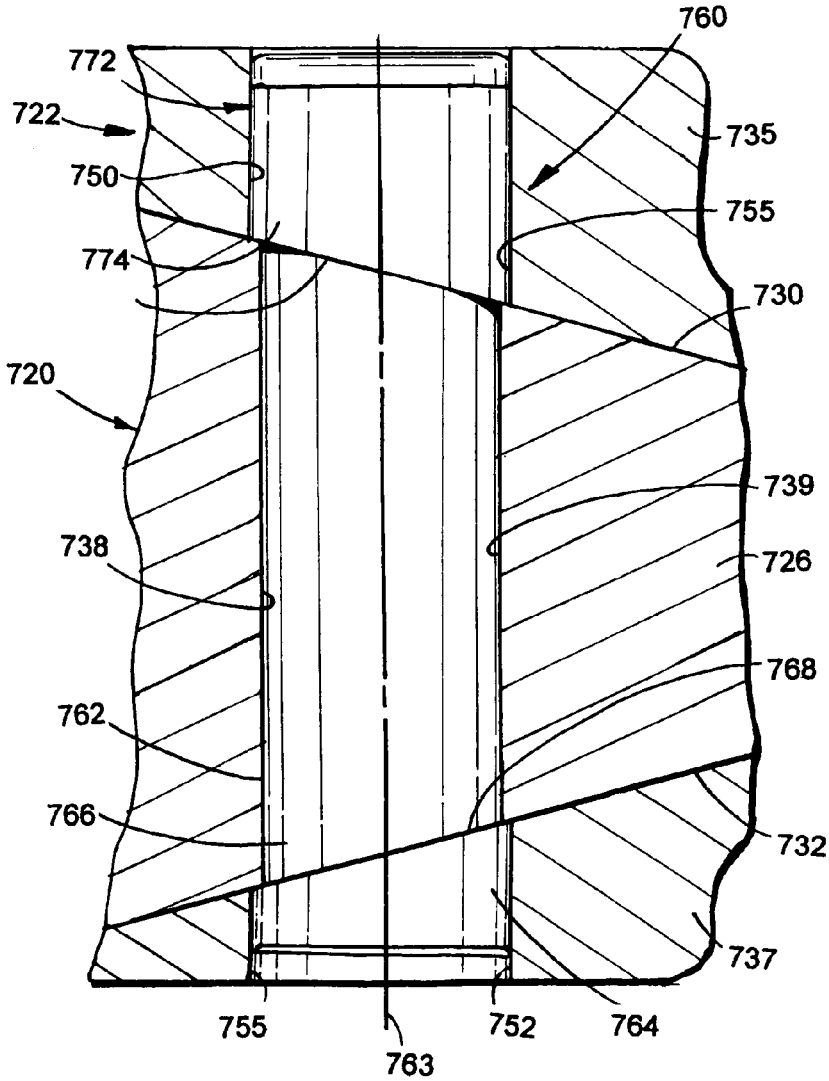
FIG. 14 is an enlarged sectional view taken along line 14-14 of FIG. 12.

As shown in FIGS. 13 and 14, pin assembly 760 is designed for substantially vertical use with a two-piece assembly including an adapter or support 720 and a replaceable tool/tooth 722 releasably connected to each other by the pin assembly 760. The adapter 720 and tool/tooth 722 are substantially similar to the adapter 20 and tool/tooth 22 described above with the exception of the following changes. The pin receiving opening or bore 738 (FIGS. 13 and 14) defined toward the rear of the nose portion 726 has a vertical rather than horizontal disposition and opens to opposed top and bottom exterior sides or surfaces 730 and 732, respectively, of adapter 720. Moreover, and as shown in FIGS. 13 and 14, the top and bottom sides or surfaces 730 and 732, respectively, of adapter 720 are slanted and angularly converge toward each other. In the illustrated embodiment, each exterior top and bottom surface 731, 732 of the tooth/tool 722 is provided with a suitable boss 735, 737 arranged in surrounding relation to that area on the respective surface of the tool/tooth 722 through which the pin assembly 760 projects. Moreover, in the embodiment shown in FIG. 14, the pin receiving opening or bore 738 defined toward the rear of the nose portion 726 has a closed marginal edge defining an inner surface 739 having a generally elliptical-like profile or configuration along the length thereof rather than a circular cross-sectional configuration as described above regarding bore 38. In one form, the elliptical-like profile or configuration of the pin receiving bore 738 is preferably elongated in a direction generally paralleling the longitudinal centerline 733 (FIG. 12) of the adapter 720. Moreover, the axially aligned openings 750 and 752 on opposed sides of the cavity 738 and defined by the opposed sides or surfaces 730, 732 of the tool/tooth 722 each have a closed marginal edge defining an inner surface 755 and are each generally circular in cross-sectional configuration rather than the elongated cross-sectional shape illustrated in FIG. 2.

In the form illustrated in FIGS. 15 and 16, pin assembly 460 includes a multiple piece structure including a pair of retaining pins 762 and 772 which, when assembled, are axially aligned relative to each other along axis 763. As shown, pin 762 includes an enlarged head portion 764 and an axially elongated shank portion 766. The head portion 764 of pin 762 is configured to fit within the opening 752 in the tooth/tool 722. As shown, however, the head portion 764 of pin 762 is too large to fit within the pin receiving opening or bore 738 defined in the nose portion 726 of adapter 720. Moreover, and as shown in FIG. 15, the enlarged head portion 764 and shank portion 766 of pin 762 are sized relative to each other such that a shoulder or step 768 is provided at the juncture of the two portions 764 and 766 for engagement with the underside or bottom 732 of the adapter 420. Notably, and to promote positive engagement therebetween, the shoulder or step 768, defined at the juncture of head portion 764 and shank portion 766 of pin 762, is slanted or angled at substantially the same angle or slant as is the surface or side 732 of the adapter 720 against which the shoulder 768 is to engage as discussed below.

To add rigidity to the pin assembly 760, the shank portion 766 of pin 762 is axially elongated for a distance substantially equal to the distance between the opposed surfaces 730, 732 of the adapter 720 in that area through which the shank portion 766 of pin 762 passes. As shown in FIG. 17, shank portion 766 of pin 762 preferably has a generally elliptical-like cross-sectional configuration complementary to the cross-sectional configuration of the pin receiving bore 738 in support 720 (FIG. 14). Suffice it to say, the shank portion 766 of pin 762 is sized to endwise pass through the opening 752 in the tool/tooth 722 and is configured to slidably fit within and operably engage at least a portion of the inner surface 739 of the bore 738 in the adapter 720 while preventing pin assembly 760 from turning about axis 763.

As shown, the distal or free end of the shank portion 766 opposite from the head portion 764 of pin 762 is slanted or angled in a direction corresponding to that provided on the top or upper surface 730 of the adapter 720 such that, in a preferred form, the shank portion 766 of pin 762 does not protrude past the top surface 730 of the adapter and, thus, does not interfere with the tooth/tool 722 being slidably moved into operable combination with the adapter 720. In a most preferred form, the distal or free end of the shank portion 766 opposite from the head portion 764 of pin 762 is slanted or angled at an angle substantially equal to that angle on the top surface 730 of the adapter 720.

As shown in FIG. 15, retaining pin 772 also includes an enlarged head portion 774 and a shank portion 776. The head portion 774 of pin 772 is too large to fit within the pin receiving bore 738 defined in the nose portion 726 of adapter 720. Suffice it to say, the cross-section configuration of the head portion 774 complements the cross-sectional configuration of the opening 750 in the tooth 722.

As shown in FIGS. 14 and 15, the head portion 774 and shank portion 776 of pin 772 are sized relative to each other such that a shoulder 778 is provided at the juncture therebetween. Notably, and to promote positive engagement therebetween, the shoulder or step 778 defined at the juncture of head portion 774 and shank portion 776 of pin 772 is slanted or angled at substantially the same angle or slant as is the surface or side 730 of the adapter 720 and against which the shoulder 778 is to engage as discussed below. Accordingly, and after pins 762 and 772 are axially assembled relative to each other, the distance between the shoulders 768 and 778 of pins 762 and 772, respectively, is substantially equal to the distance across that portion of the adapter 720 through which the pin receiving bore 738 extends.

Pin assembly 760 further includes a fastener 780 for drawing the pins 762 and 772 axially toward each other and for, ultimately, securing the pins 762 and 772 in operable but releasable combination relative to each other. As shown in FIG. 15, fastener 780 preferably includes an enlarged head portion 782 with an externally threaded shank portion 784 extending therefrom. Fastener 780 preferably defines a radial shoulder 786 at the juncture of the head portion 782 and shank portion 784. The head portion 782 of fastener 780 is preferably configured to releasably accommodate a suitable tool (not shown) used to turn fastener 780 about axis 763.

In the form shown in FIGS. 15 and 16, pin 772 defines a preferably coaxial counterbore 773 open at opposite ends thereof. Counterbore 773 defines a radial step 775 along the length thereof. According to this embodiment, pin 762 defines, at the end opposite from head portion 764, a counterbore 765 including an internally threaded bore 765' for receiving and establishing a threaded juncture with the threaded shank portion 784 of fastener 780. Preferably, the threads within the bore 765 of pin 762 and on the shank portion 784 of fastener 780 have a relatively "fine" pitch thereto to facilitate the holding power thereof. Moreover, and as shown in FIG. 16, the shank portion 784 of fastener 780 preferably includes structure in the form of a conventional non-metallic insert 785 for inhibiting inadvertent rotation of the fastener 780 after the pins 762 and 772 of assembly 760 are secured in operable combination relative to each other.

As shown in FIG. 15, the distal ends of the pins 762 and 772 of assembly 760 are arranged in operable combination relative to each other to enhance the strength and flexural rigidity of the pin assembly 760 while reducing stress on the fastener 780. The larger diameter end of the counterbore 765 opens to the distal end of pin 762 and forms a radial step or shoulder 767 with the smaller diameter and threaded end 765' of the counterbore 765. In the embodiment illustrated in FIG. 15, and after being installed within bore 738 (FIG. 14) of the adapter 720, the free or distal ends of pins 762, 772 are arranged in telescoping relation relative to each other In the embodiment shown in FIG. 15, shank portion 776 of pin 772 has an outside diameter equal to or slightly less than the inside diameter of the larger end of the counterbore 765 defined by pin 762. As such, and after the distal ends of pins 762, 772 are brought together from opposite axial directions within bore 738 (FIG. 14) of the adapter 720, shank portion 776 of pin 772 telescopically fits axially within the larger diameter portion of the counterbore 765 of pin 762 while allowing the shank portion 766 of pin 762 to axially extend along the majority of the length of the bore 738 (FIG. 14) defined by adapter 720. Notably, the operable combination established between the opposed distal ends of the pins 762, 772 compensates for tolerance variations between the surfaces or sides 730, 732 of the adapter 720 (FIG. 14) while maintaining the confronting end sections of the pins 762, 772 in operable combination relative to each other.

Preferably, pin assembly 760 also includes seal structure 792 for inhibiting contaminants including moisture, dust, and dirt from interfering with proper operation of fastener 780 and pin 762. In a preferred embodiment, seal structure 792 includes a ring or washer 794, preferably fabricated from elastomeric material. As shown in FIG. 15, washer 794 is preferably seated between the radial shoulder 767 defined by the counterbore 765 and the distal end of the shank portion 776 of pin 772. As used herein and throughout, the term "elastomeric material" means and refers to: natural rubber, synthetic rubber, plastic, polyvinyl, polymide materials, nylon, composites, polyethylene, ultrahigh molecular weight materials, and any of numerous organic, synthetic materials which can serve to "seal" and protect the juncture established between fastener 780 and pin 762 of assembly 760. In the illustrated embodiment, ring or washer 794 is provided with a generally centralized opening or hole 796 having a diameter generally equal to or slightly larger than the diameter of the shank portion 784 of fastener 780 but smaller than the diameter of the larger diameter of the counterbore 765 opening to the distal end of pin 762.

As will be appreciated, and after shank portion 784 of fastener 780 operably engages with the threaded bore 765' of pin 762, rotation of the fastener 780 in a first direction causes pins 762 and 772 to be axially drawn toward each other until the shoulders 768 and 778 on the pins 762 and 772, respectively, tightly clamp against their confronting surfaces 730, 732 on the adapter 720. As the pins 762, 772 are tightened against the adapter 720, the elastomeric ring or washer 794 is squeezed between the radial shoulder 767 of the counterbore 765 and the distal end of the shank portion 776 of pin 772 thus causing the elastomer of washer 794 to flow around the fastener shank portion 784. Likewise, the squeezed elastomer of ring or washer 794 tends to flow and fill tolerance variations or voids separating the exterior surface of shank portion 776 of pin 772 from the interior surface defined by the counterbore 765 of pin 762. As such, contaminants including small rocks, stones, dirt, dirt fines, dust, and moisture are inhibited from passing between the threaded juncture established between pin 762 and fastener 780. Of course, eliminating or reducing clogging, oxidation or rusting of the mating surfaces between the externally threaded shank portion 784 of fastener 780 and the threaded bore 766 of pin 762 tends to facilitate rotation of the fastener 780 in a direction to effect release of pin assembly 760.

In a most preferred embodiment, the pin through which fastener 480 axially passes further includes structure 800 operably associated with that pin to further inhibit dirt, debris, moisture and other contaminants from interfering with proper operation of the fastener 780. Structure 800 for inhibiting dirt, debris, moisture and other contaminants from interfering with proper operation of the fastener 780 can be substantially similar to structure 500 discussed above and, thus, no further details need be provided for a complete and full understanding thereof.

There is also disclosed a method for releasably securing a ground engaging tool to a nose portion of a mounting support. The method will be described with reference to that embodiment shown in FIGS. 1 through 5 but it should be appreciated that the method likewise applies to those other embodiments of the invention disclosed above. The method comprises the steps of: inserting a first member or pin 62 into a lengthwise section of the bore 38 in the nose portion 26 of the support/adapter 20 through opening 50 defined by the tool/tooth 22, with the first pin member 62 including a head portion 64 and a shank portion 66, and with the head portion 64 of the first pin or member 62 being configured to engage with at lesat a section of a marginal portion 55 of the respective opening 50 in the tool/tooth 22 through which the pin 62 is inserted, and with the shank portion 66 of the first pin or member 62 being configured to engage with at least a section of a marginal portion 39 of the bore 38 defined by the nose portion 26 of the adapter 20; inserting a second member or pin 72 into a lengthwise section of the bore 38 in the nose portion 26 of the support 20 through the other opening 52 defined by the tool/tooth 22, with the second member or pin 72 including a head portion 74 and a shank portion 76, with the head portion 74 of the first pin 72 being configured to engage with at least a section of a marginal portion 55 of the respective opening 52 in the tool/tooth 22 through which the pin or member 72 is inserted, and with a free end of the shank portion 76 of the second member or pin 72 being configured to be arranged in a cooperative relation relative to the free end of the shank portion 66 of the first member or pin 62 so as to add structural rigidity to the pin assembly 60; and securing the first and second members or pins 62 and 72, respectively, against inadvertent axial displacement within the first and second aligned openings 50, 52 defined by the tool/tooth and the bore 38 defined by the nose portion 26 of the support 20.

In one form, the method for securing a ground engaging tool 22 on a nose portion 26 of a mounting support 20 includes the further step of: inserting a threaded fastener 80 through one of the pins or members 72 to form a threaded juncture with the other pin or member 62 whereby securing the first and second pins or members 62, 72 against inadvertent axial displacement relative to each other. In another form, the method for securing a ground engaging tool 22 on a nose portion 26 of a mounting support 20 includes the further step of: protecting the threaded juncture established between the fastener 80 and member or pin 62 by inhibiting dirt, debris, or moisture from contaminating the threaded juncture.

With the embodiments of pin assembly described above, the heretofore known problems associated with elongated pinning systems are substantially reduced-if not eliminated. More specifically, the pin assembly of this invention allows for essentially hammerless operation when it is to be removed from two-part assembly to allow for repair or replacement of the tool/tooth. With the present invention, repair and/or replacement of the tool/tooth is quickly and easily facilitated in an optimum manner simply by rotating the fastener and thereby releasing the connection between pins of the pin assembly thereby readily allowing for repair/replacement of the replacement part. As mentioned above, with the preferred design, either the cross-sectional configuration of the head portion within either opening in the tool/tooth or the cross-sectional configuration of the shank portion within the bore of the adapter will inhibit rotation of the pin assembly in response to rotation of fastener used to operably interconnect the free ends of the pins.

After the retaining pins have been operably disconnected from each other, either retaining pin can be removed from operable association with the adapter and digging tooth. Removal of either pin will allow for a suitable tool to be placed through either tooth opening and the pin receiving opening in the adapter to affect removal of the remaining pin. Moreover, the inner surface of each tooth opening along with the inner surface of the pin receiving opening in the adapter guides such a tool toward the remaining pin to further facilitate removal of remaining portions of the pin assembly and, ultimately, facilitate operable disconnection between the adapter and tooth/tool in a timely and efficient manner. After the replacement part has been repaired/replaced, the pins are reinserted in opposed axial directions through the tooth openings and through the bore in the adapter bringing the free ends of the ins into operable combination relative to each other. Thereafter, the fastener isn used to secure the free ends of the pins in operable association relative to each other to again releasably secure adapter and tool/tooth in operable combination with each other.

In a preferred form, the seal structure for the pin assembly protects the threaded juncture between the fastener and that pin threadably engaged by the fastener thereby facilitating release of the pin assembly notwithstanding exposure of the two-part digging system to environmental conditions which would normally cause corrosion, oxidation, rusting and deterioration of the operative junction between the parts. Moreover, the cap structure associated with that pin through which the fastener extends is intended to inhibits contaminants and/or moisture from reaching the threaded juncture between the fastener and pin.

From the foregoing it will be observed numerous modifications and variations can be effected without departing or detracting from the true spirit and novel scope of the present invention. It will be appreciated, the present disclosure is intended to set forth exemplifications of the invention which are not intended to limit the invention to the specific embodiments illustrated. The disclosure is intended to cover by the appended claims all such modifications and variations as fall within the spirit and scope of the claims.

What is claimed is:

1. A pin assembly for releasably securing a ground engaging tool on a nose portion of a mounting support by extending through spaced and substantially aligned openings defined by said tool and a bore defined by the nose portion of said support, said pin assembly comprising:

first and second axially aligned pins, each pin having a head portion and a shank portion, with each pin being configured such that, after being inserted through one of the axially aligned openings defined by said tool, the shank portion of each pin engages at least a lengthwise section of the marginal portion of the bore defined by the nose portion of the adapter while the head portion of each pin engages a marginal portion of the respective opening in said tool through which said first pin is inserted;

a fastener having an enlarged head portion and a treaded shank portion, with the threaded shank portion of said fastener being axially insertable through one of said pins and threadably engagable with the other of said pins for maintaining said pins in operable combination relative to each other whereby maintaining said tool and support in operable relation relative to each other; and wherein end sections of the shank portions of said pins are arranged in telescopic relation relative to each other so as to enhance the flexural rigidity of said pin assembly while reducing stresses on the threaded shank portion of said fastener.

2. The pin assembly according to claim 1, further including seal structure for inhibiting contaminants from interfering with proper operation of the fastener and that pin threadably engagable with said fastener.

3. The pin assembly according to claim 1, wherein the shank portion of each pin has a generally cylindrical-like configuration along a major lengthwise section thereof.

4. The pin assembly according to claim 1, wherein the head portion of each pin has a generally cylindrical-like configuration and the shank portion of each pin has a generally elliptical-like configuration along a major lengthwise section thereof, and with a shoulder being defined at the conjuncture of the head portion and shank portion of each pin.

5. The pin assembly according to claim 1, further including structure operably associated with the pin through which said fastener is axially inserted for protecting said fastener by inhibiting contaminants from interfering with proper operation of said fastener.

6. A pin assembly for releasably securing a ground engaging tooth having a cutting end and a hollow mounting end to a nose portion of an adapter by extending endwise through two axially aligned holes defined by said tooth and a bore extending through the nose portion of said adapter, said pin assembly comprising:

a first elongated and rigid member and a second rigid member adapted to be arranged in axial relation relative to said first member, with each rigid member having a head portion and a shank portion, and wherein each rigid member is configured such that, after being axially inserted through one of said axially aligned openings defined by said tooth, the shank portion of each rigid member engages with at least a lengthwise section of a marginal portion of the bore defined by the nose portion of the adapter while the head portion of each member engages with a marginal portion of the respective opening in said tooth through which the member is inserted; and an elongated fastener having an enlarged head portion and a threaded shank portion, with the threaded shank portion of said fastener being axially insertable through one of said members to form a threaded juncture with the other of said members so as to releasably maintain end sections of said members in cooperative relation relative to each other whereby securing said tooth and adapter in operable combination relative to each other; and wherein the end sections of the shank portions of said first and second rigid members are arranged in telescopic relation relative to each other so as to enhance the flexural rigidity of said pin assembly while reducing stress on the threaded juncture between the fastener and said first and second rigid members.

7. The pin assembly according to claim 6, further including seal structure disposed in combination with said first and second members for inhibiting contaminants from interfering with proper operation of the fastener and that member threadably engagable with said fastener.

8. The pin assembly according to claim 6, wherein the shank portion of each member has a generally cylindrical-like cross-sectional configuration along a major lengthwise section thereof.

9. The pin assembly according to claim 6, wherein the enlarged head portion of each member has a generally cylindrical-like configuration and the shank portion of each member has a generally elliptical-like cross-sectional configuration along a major lengthwise section thereof, and with a shoulder being defined at the conjuncture of the head portion and shank portion of each rigid member.

10. The pin assembly according to claim 6, further including a cap operably associated with that member through which said fastener is axially inserted for inhibiting contaminants from interfering with proper operation of said fastener.

11. A pin assembly for a ground engaging tooth assembly including an adapter having a nose portion with spaced and opposed surfaces and a bore opening to said surfaces, said tooth assembly further including a ground engaging tooth having a hollow mounting end adapted to slidably fit over and along a lengthwise section of the nose portion of said adapter and having first and second axially aligned openings arranged in general registry with the bore in said adapter when said tooth and said adapter are arranged in operable combination relative to each other, said pin assembly comprising:

first and second elongated and rigid members adapted to be arranged in axial relation relative to each other, with each rigid member including an enlarged head portion and a shank portion, with a length of the shank portion of each member being less than a distance between the spaced and opposed surfaces on said adapter, and wherein each rigid member is configured such that, after each member is axially inserted through the axially aligned openings defined by said tooth, the shank portion of each member is adapted to engage with a marginal portion of the bore defined by the nose portion of the adapter while the head portion of each member is configured to engage with a marginal portion of the respective opening in said tooth through which said member is inserted;

an elongated fastener having an enlarged head portion and a threaded shank portion, with the threaded shank portion of said fastener being axially insertable through one of said members to form a threaded juncture with the other of said members so as to releasably maintain the rigid members in operable combination relative to each other whereby maintaining said tooth and adapter in operable combination relative to each other; and wherein end sections of the shank portions of said first and second rigid members are arranged in telescopic relation relative to each other so as to enhance the flexural rigidity of said pin assembly while reducing stress on the threaded juncture between the fastener and said first and second rigid members.

12. The pin assembly according to claim 11, further including seal structure disposed in operable combination with said first and second members for inhibiting contaminants from interfering with proper operation of the fastener and that member threadably engagable with said fastener.

13. The pin assembly according to claim 11, further including a cap operably associated with that member through which said fastener is axially inserted for inhibiting contaminants from interfering with proper operation of said fastener.

14. A method for releasably securing a ground engaging tool on a nose portion of a mounting support by extending through spaced and substantially first and second aligned openings defined by said tool and a bore defined by the nose portion of said support, said method comprising the steps of:

inserting a first rigid member into a lengthwise section of the bore in the nose portion of said support through said first opening defined by said tool, with said first rigid member including a head portion and a shank portion, with the head portion of said first member being configured to engage with a marginal portion of the respective opening in said tool through which said first rigid member is inserted, and with the shank portion of said first member being configured to engage with a marginal portion of the bore defined by the nose portion of the adapter;

inserting a second rigid member into a lengthwise section of the bore in the nose portion of said support through said second opening defined by said tool, with said second rigid member including a head portion and a shank portion, with the head portion of said second rigid member being configured to engage with a marginal portion of the respective opening in said tool through which said second rigid member is inserted, and with the shank portion of said second rigid member being configured to engage with a remaining marginal portion of the bore defined by the nose portion of the adapter;

securing said first and second members against inadvertent axial displacement within the first and second aligned openings defined by said tool and the bore defined by the nose portion of said support with an elongated fastener having an enlarged head portion and a threaded shank portion, with the threaded shank portion of said fastener being insertable through one of said members to form a threaded juncture with the other of said members; and configuring end sections of the shank portion of said first and second rigid members such that said ends sections are arranged in telescopic relation relative to each other when said pin assembly is assembled whereby enhancing the flexural rigidity of said pin assembly while reducing stress on the threaded juncture between the fastener and said first and second rigid members.

15. The method for releasably securing a ground engaging tool on a nose portion of a mounting support according to claim 14, including the further step of:

protecting the threaded juncture established between said fastener and one of said members by inhibiting dirt, debris, or moisture from contaminating said threaded juncture.

* * * * *